US009163598B2

(12) United States Patent
Ono et al.

(10) Patent No.: US 9,163,598 B2
(45) Date of Patent: Oct. 20, 2015

(54) ENGINE WITH VARIABLE FLOW RATE OIL PUMP

(71) Applicants: YAMADA MANUFACTURING CO., LTD., Kiryu-shi, Gunma (JP); HONDA MOTOR CO., LTD., Tokyo (JP)

(72) Inventors: Yasunori Ono, Isesaki (JP); Junichi Miyajima, Isesaki (JP); Noriyuki Kawamata, Wako (JP); Hayato Maehara, Wako (JP); Eisuke Kajihara, Wako (JP); Kazuhiro Takeuchi, Wako (JP); Norihiko Gogami, Wako (JP); Satoshi Ino, Wako (JP)

(73) Assignees: YAMADA MANUFACTURING CO., LTD., Kiryu-Shi (JP); HONDA MOTOR CO., LTD., Tokyo (JP)

( * ) Notice: Subject to any disclaimer, the term of this patent is extended or adjusted under 35 U.S.C. 154(b) by 375 days.

(21) Appl. No.: 13/845,361

(22) Filed: Mar. 18, 2013

(65) Prior Publication Data

US 2013/0255643 A1 Oct. 3, 2013

(30) Foreign Application Priority Data

Mar. 28, 2012 (JP) ..... 2012-074810

(51) Int. Cl.
*F02M 59/00* (2006.01)
*F01M 1/16* (2006.01)

(52) U.S. Cl.
CPC *F02M 59/00* (2013.01); *F01M 1/16* (2013.01)

(58) Field of Classification Search
CPC ..... F01M 1/02; F01M 1/16; F04C 11/001; F04C 14/02; F02M 59/00
USPC ..... 123/196 R, 196 CP, 73 AD; 417/213, 417/216, 426–429, 279, 286, 297, 300, 310, 417/410.3, 410.4, 440, 307
See application file for complete search history.

(56) References Cited

U.S. PATENT DOCUMENTS

| | | | | |
|---|---|---|---|---|
| 7,588,011 | B2 * | 9/2009 | Ono et al. | 123/196 R |
| 2012/0070318 | A1 | 3/2012 | Kai et al. | |
| 2013/0255617 | A1 * | 10/2013 | Kawamata et al. | 123/188.9 |

FOREIGN PATENT DOCUMENTS

| | | |
|---|---|---|
| JP | 59-101593 | 6/1984 |
| JP | 4-234588 | 8/1992 |

(Continued)

OTHER PUBLICATIONS

Japanese Office Action to corresponding JP Application No. 2012-074510, Aug. 4, 2015.

*Primary Examiner* — Stephen K Cronin
*Assistant Examiner* — Xiao Mo
(74) *Attorney, Agent, or Firm* — Mori & Ward, LLP

(57) ABSTRACT

The engine with a variable flow rate oil pump includes a subsidiary relief passage that extends from an oil passage-switching valve to a subsidiary oil pump, a main relief passage that extends from the oil passage-switching valve to the main oil pump separately from the subsidiary relief passage, and a check valve that is provided in the subsidiary discharge passage and cuts off the flow of oil from the main discharge passage side to the oil passage-switching valve side. The oil passage-switching valve has a main pressure-adjusting chamber for the main oil pump, a subsidiary pressure-adjusting chamber of for the subsidiary oil pump, and a spool valve that performs partitioning between the main pressure-adjusting chamber and the subsidiary pressure-adjusting chamber.

8 Claims, 16 Drawing Sheets

(56) References Cited

FOREIGN PATENT DOCUMENTS

| | | |
|---|---|---|
| JP | 2598994 Y2 | 8/1995 |
| JP | 2008-223755 | 9/2008 |
| JP | 2010-24926 | 2/2010 |
| JP | 2012-62837 | 3/2012 |

* cited by examiner

ENGINE WITH VARIABLE FLOW RATE OIL PUMP

Priority is claimed on Japanese Patent Application No. 2012-74810, filed on Mar. 28, 2012, the contents of which are incorporated herein by reference.

BACKGROUND OF THE INVENTION

1. Field of the Invention

The present invention relates to an engine with a variable flow rate oil pump that is suitable for small vehicles, such as motorcycles.

2. Description of Related Art

In the related art, an engine is known that includes a variable flow rate oil pump having a main pump section and a subsidiary pump section with mutually different discharge rates, and an oil pressure-adjusting valve that adjusts supply oil pressure from the main pump section and the subsidiary pump section to oil pressure supply destinations (for example, refer to Japanese Utility Model (Registered) Publication No. 2598994).

During low-speed rotation of an engine, the discharge rate of the main pump section is supplied to the oil pressure supply destinations via a main discharge passage, and the discharge rate of the subsidiary pump section joins the oil pressure of the main discharge passage via a subsidiary discharge passage having the oil pressure-adjusting valve and is supplied to the oil pressure supply destinations.

The oil pressure-adjusting valve operates with a rise in the oil pressure of the main discharge passage (main pump section), and during high-speed rotation of the engine (during a rise in the oil pressure of the main discharge passage), the oil pressure of the subsidiary discharge passage (subsidiary pump section) is guided to a relief passage from the oil pressure-adjusting valve and is returned to a pump suction side, a portion of the oil pressure of the main discharge passage flows back in a region on the downstream side of the oil pressure-adjusting valve in the subsidiary discharge passage from a joining portion of the subsidiary discharge passage, is guided from the oil pressure-adjusting valve to the relief passage, and is returned to the pump suction side.

SUMMARY OF THE INVENTION

In a state where the discharge rate is adjusted by the operation of the oil pressure-adjusting valve as in the above related art, oil pressure should be allowed to be relieved well from the main discharge passage and the subsidiary discharge passage in order to maintain a discharge rate corresponding to a required amount of oil based on a design.

However, in a configuration in which two types of discharge pressures with a difference in height in the main pump section and the subsidiary pump section are made to join each other within the oil pressure-adjusting valve and this is relieved from a single relief passage, the balance between the high and low discharge rates of the main pump section and the subsidiary pump section that flow into the oil pressure-adjusting valve should be taken into consideration, and there is a problem in that the design of an oil pressure adjustment circuit becomes complicated.

An object of aspects of the present invention is to facilitate the design of an oil pressure adjustment circuit that allows the discharge oil of each pump section to be relieved, in an engine with a variable flow rate oil pump including a main pump section and a subsidiary pump section with mutually different discharge rates.

In order to achieve the above object, an engine with a variable flow rate oil pump according to aspects of the present invention adopts configurations described below.

(1) An aspect of the present invention is an engine with a variable flow rate oil pump including a main pump section and a subsidiary pump section having mutually different discharge rates, and an oil pressure-adjusting valve that adjusts supply oil pressure from the main pump section and the subsidiary pump section to oil pressure supply destinations. The engine includes a main discharge passage that extends from the main pump section; a subsidiary discharge passage that extends from the subsidiary pump section and joins the main discharge passage via the oil pressure-adjusting valve; a subsidiary relief passage that extends from the oil pressure-adjusting valve to the suction side of the subsidiary pump section; a main relief passage that extends from the oil pressure-adjusting valve to the suction side of the main pump section separately from the subsidiary relief passage; and a check valve that is provided on the downstream side of the oil pressure-adjusting valve in the subsidiary discharge passage and cuts off the flow of oil from the main discharge passage side to the oil pressure-adjusting valve side. The oil pressure-adjusting valve has a main pressure-adjusting chamber for adjusting the discharge rate of the main pump section, a subsidiary pressure-adjusting chamber for adjusting the discharge rate of the subsidiary pump section, and a valve body that performs partitioning between the main pressure-adjusting chamber and the subsidiary pressure-adjusting chamber in an oil-tight manner.

(2) In the aspect as (1) described above, the discharge rate of the subsidiary pump section may be larger than the discharge rate of the main pump section.

(3) In the aspect as (1) or (2) described above, the engine is an internal combustion engine and the main pump section and a subsidiary pump section may be driven by the power of the engine.

(4) In the aspect as any one of (1) to (3) described above, the main pump section and the subsidiary pump section may be driven by a common drive shaft and may be individually arranged on the drive shaft to constitute an integral pump assembly.

(5) In the aspect as (4) described above, the check valve may be provided in a subsidiary discharge passage formed in the pump assembly.

(6) In the aspects as (4) or (5) described above, the check valve may be sandwiched between a plurality of members that constitute the pump assembly.

(7) In the aspect as any one of (1) to (6) described above, the operation axis direction of the check valve may be arranged parallel to the operation axis direction of the oil pressure-adjusting valve.

(8) In the aspect as any one of (1) to (7) described above, the operation axis direction of the oil pressure-adjusting valve and the direction of the drive shaft of the variable flow rate oil pump may be arranged so as to be orthogonal to each other.

According to the aspect as (1) described above, when two types of discharge pressures with a difference in height in the main pump section and the subsidiary pump section are relieved from the oil pressure-adjusting valve, these respective oil discharge pressures are relieved from dedicated relief passages to the pump suction side, respectively, without joining each other within the oil pressure-adjusting valve.

Additionally, the check valve that cuts off the flow of oil from the main discharge passage side to the oil pressure-adjusting valve side is provided in the subsidiary discharge passage. Thereby, the oil pressure of the main pump section does not flow back in the subsidiary discharge passage even when the total oil pressure of the subsidiary pump section is relieved.

Thereby, it is possible to relieve the oil pressure of the main discharge passage independently from the subsidiary relief passage, calculation of the oil pressure within the oil pressure-adjusting valve becomes easy, and the design of the oil pressure adjustment circuit can be facilitated.

According to the aspect as (2) described above, the oils discharged from both the pump sections depending on the operating state of the respective pump sections are in the state of being supplied to the main discharge passage. In this case, however, since the discharge rate of the subsidiary pump section that performs supply to the main discharge passage is made greater than the discharge rate of the main pump section, the check valve is opened by the oil discharged from the subsidiary pump section, so that this oil can be circulated to the main discharge passage side well.

Additionally, in a case where the discharge rate of the main pump section increases and the amount supplied to the main discharge passage is filled, backflow of oil from the main discharge passage can be prevented by the check valve even if the operation of the subsidiary pump section is stopped.

In this way, since circulation of the discharge oil from the subsidiary pump section with a larger discharge rate and backflow prevention from the main discharge passage are made possible to allow for stopping of the subsidiary pump section under predetermined driving conditions, the effect of reducing a pump driving force in predetermined operation can be increased.

According to the aspect as (3) described above, it is possible to contribute to the improvement in fuel consumption of an internal combustion engine by a reduction in the pump driving force under specific operation.

According to the aspect as (4) described above, a driving mechanism of both the pump sections can be made common parts to achieve simplification, and an integral pump assembly can be provided to reduce the size thereof.

According to the aspect as (5) described above, the check valve is provided in the pump assembly. Thereby, even in a case where the check valve is added, it is possible to cope with this with only a small change in the pump assembly without being accompanied with a great design change of the engine.

According to the aspect as (6) described above, the check valve is sandwiched between a plurality of members of the pump assembly. Thereby, the check valve can be provided using pump components while making a special attachment member unnecessary.

According to the aspect as (7) described above, the size of the variable flow rate oil pump can be reduced by matching the axial directions of the check valve and the adjusting valve.

According to the aspect as (8) described above, in a case where the operation axis direction of the oil pressure-adjusting valve and the direction of the drive shaft of the variable flow rate oil pump are arranged so as to be orthogonal to each other, the size of the variable flow rate oil pump can be reduced by making the operation axis direction of the check valve parallel with the direction of the drive shaft of the variable flow rate oil pump.

DESCRIPTION OF THE EMBODIMENTS

Figure 1:
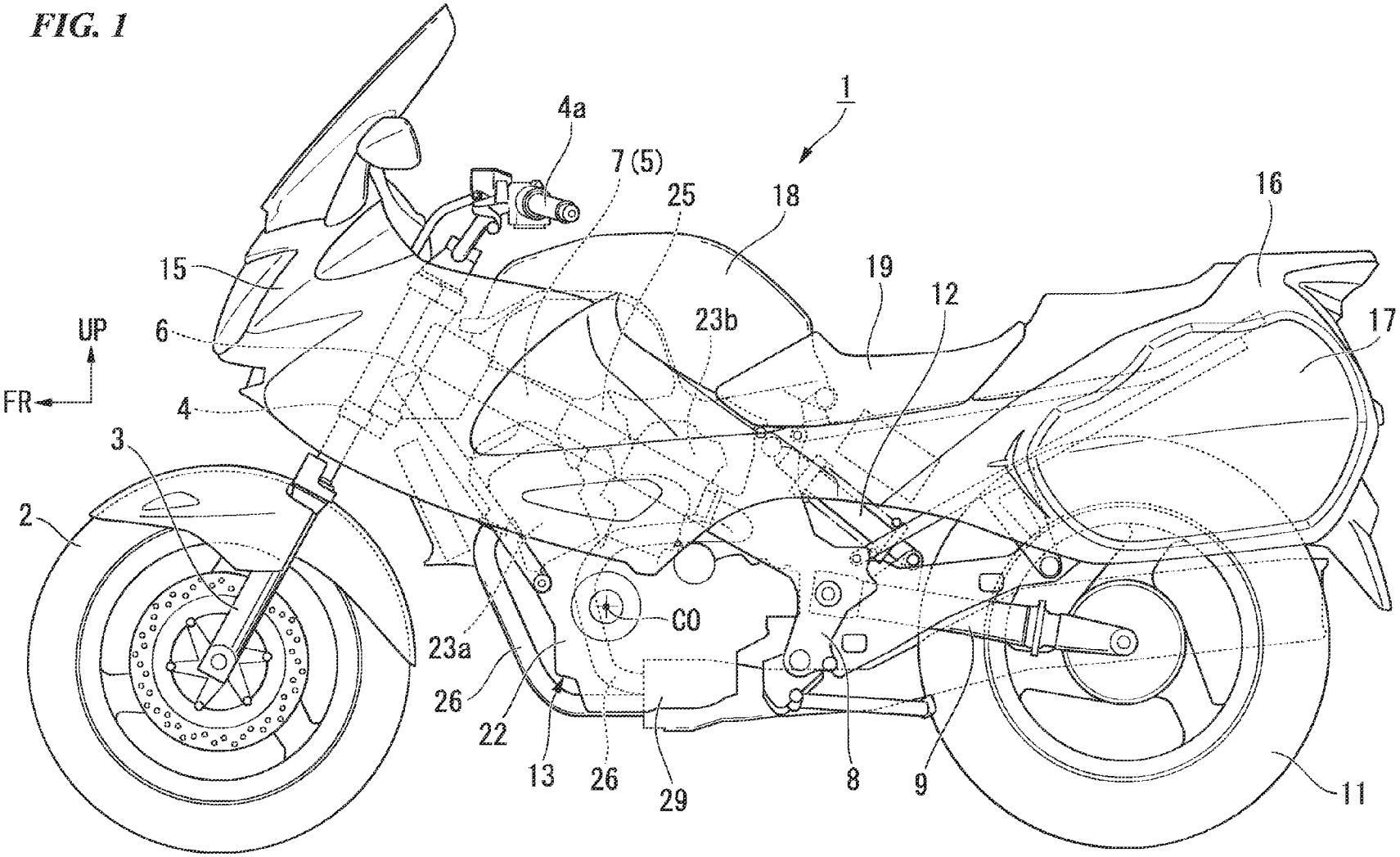
FIG. 1 is a left side view of a motorcycle in a first embodiment of the present invention.

Hereinafter, embodiments of the present invention will be described with reference to the accompanying drawings. It is supposed that directions, such as front, rear, right, and left in the following description are the same as directions in a vehicle to be described below particularly if there is no description. Arrow FR indicating the front of the vehicle, arrow LH indicating the left of the vehicle, and arrow UP indicating the upper side of the vehicle are shown in suitable places in the drawings to be used in the following description.

First Embodiment

In a motorcycle (saddle riding type vehicle) 1 shown in FIG. 1, a front wheel 2 is rotatably supported to a lower end of a front fork 3. An upper portion of the front fork 3 is steerably and pivotally supported on a head pipe 6 in the front end of a vehicle body frame 5 via a steering stem 4. A steering handle 4*a* is attached to an upper portion of the steering stem 4 (or front fork 3).

A mainframe 7 extends backward from the head pipe 6, and continues to a pivot frame 8. A front end portion of a swing arm 9 is pivotally supported on the pivot frame 8 such that it can swing up and down. A rear wheel 11 is rotatably supported to a rear end portion of the swing arm 9.

A cushion unit 12 is interposed between the swing arm 9 and the vehicle body frame 5. An engine (internal combustion engine) 13 that is a prime mover of the motorcycle 1 is mounted inside the vehicle body frame 5.

A left arm of the swing arm 9 is made hollow, and has a drive shaft drawn from the engine 13 inserted therethrough. The power transmission between the engine 13 and the rear wheel 11 is performed via this drive shaft.

A vehicle body front portion of the motorcycle 1 is covered with a front cowl 15, and a vehicle body rear portion is covered with a rear cowl 16. Right and left pannier cases 17 are built in both sides of a rear portion of the rear cowl 16. A fuel tank 18 is disposed above the mainframe 7, and a seat 19 is disposed behind the fuel tank 18.

Figure 2:
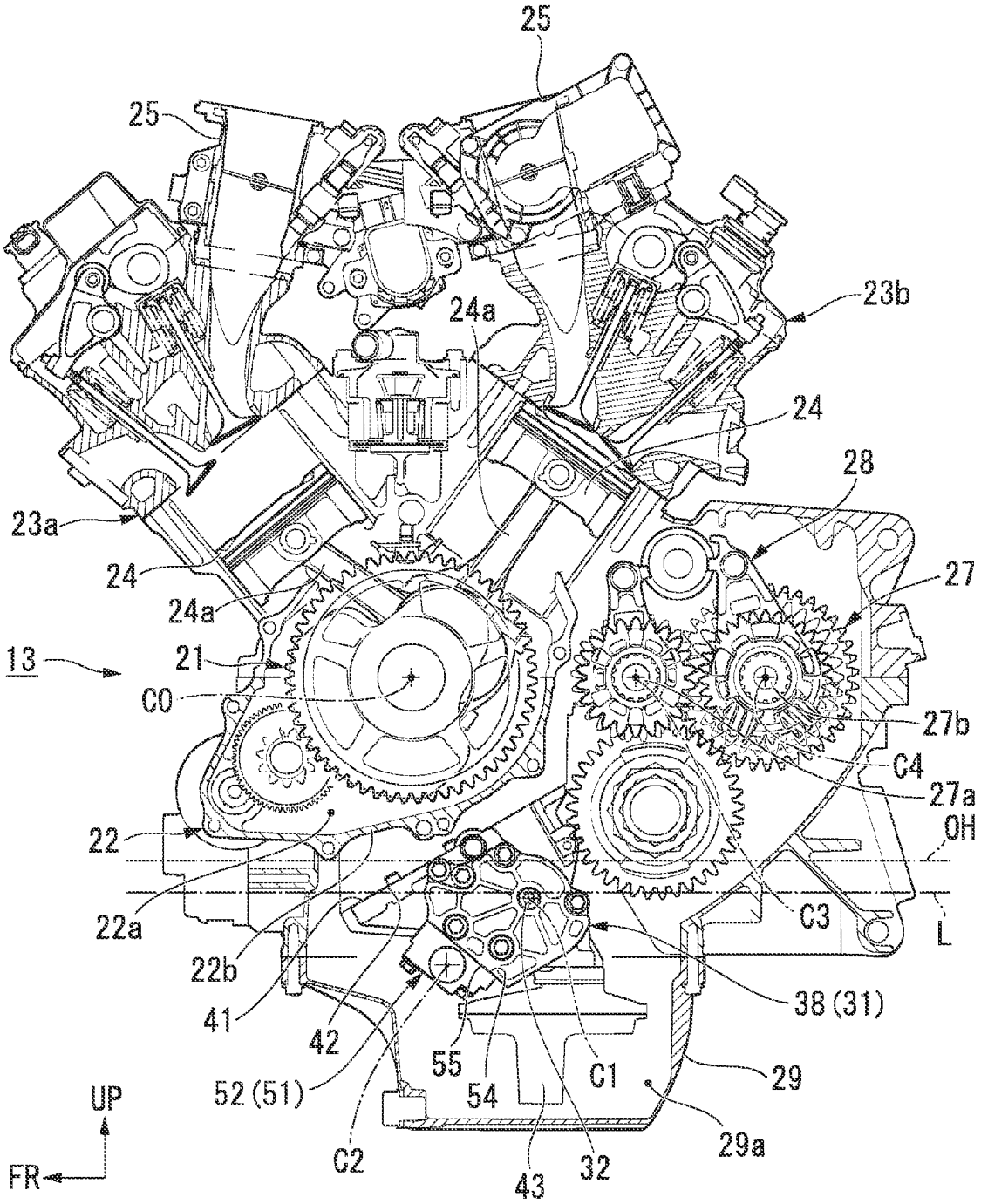
FIG. 2 is a left side view of an engine of the motorcycle.

Referring to FIG. 2 together, the engine 13 is a V-type engine in which the rotation center axis C0 of a crankshaft 21 is made to run along a vehicle width direction (right-and-left direction), and front and rear cylinders 23*a* and 23*b* are provided on a crankcase 22 so as to be erected therefrom.

Pistons 24 are fitted into the front and rear cylinders 23*a* and 23*b*, respectively, such that they can reciprocate back and forth, and each of the pistons 24 is coupled to a crankpin of the crankshaft 21 via a connecting rod 24*a*.

Between the front and rear cylinders 23*a* and 23*b*, throttle bodies 25 connected to intake ports of the cylinders are arranged. In front of the front cylinder 23*a* and behind the rear cylinder 23*b*, an exhaust pipe 26 that extends from the exhaust ports of the cylinders is arranged.

A transmission 27 is accommodated within a rear portion of the crankcase 22. A main shaft 27*a* is an input shaft of the transmission 27, and a counter shaft 27*b* is an output shaft of the transmission 27. A change mechanism 28 changes over the gear ratio of the transmission 27.

An oil pan 29 is attached to a lower portion of the crankcase 22, and an oil pump unit (a variable flow rate oil pump) pumps engine oil (hereinafter simply referred to as oil) within the oil pan 29 to respective parts of the engine 13.

The main shaft 27*a* and the counter shaft 27*b* have rotation center axes C3 and C4, respectively, which are parallel to the axis C0 of the crankshaft 21.

Figure 3:
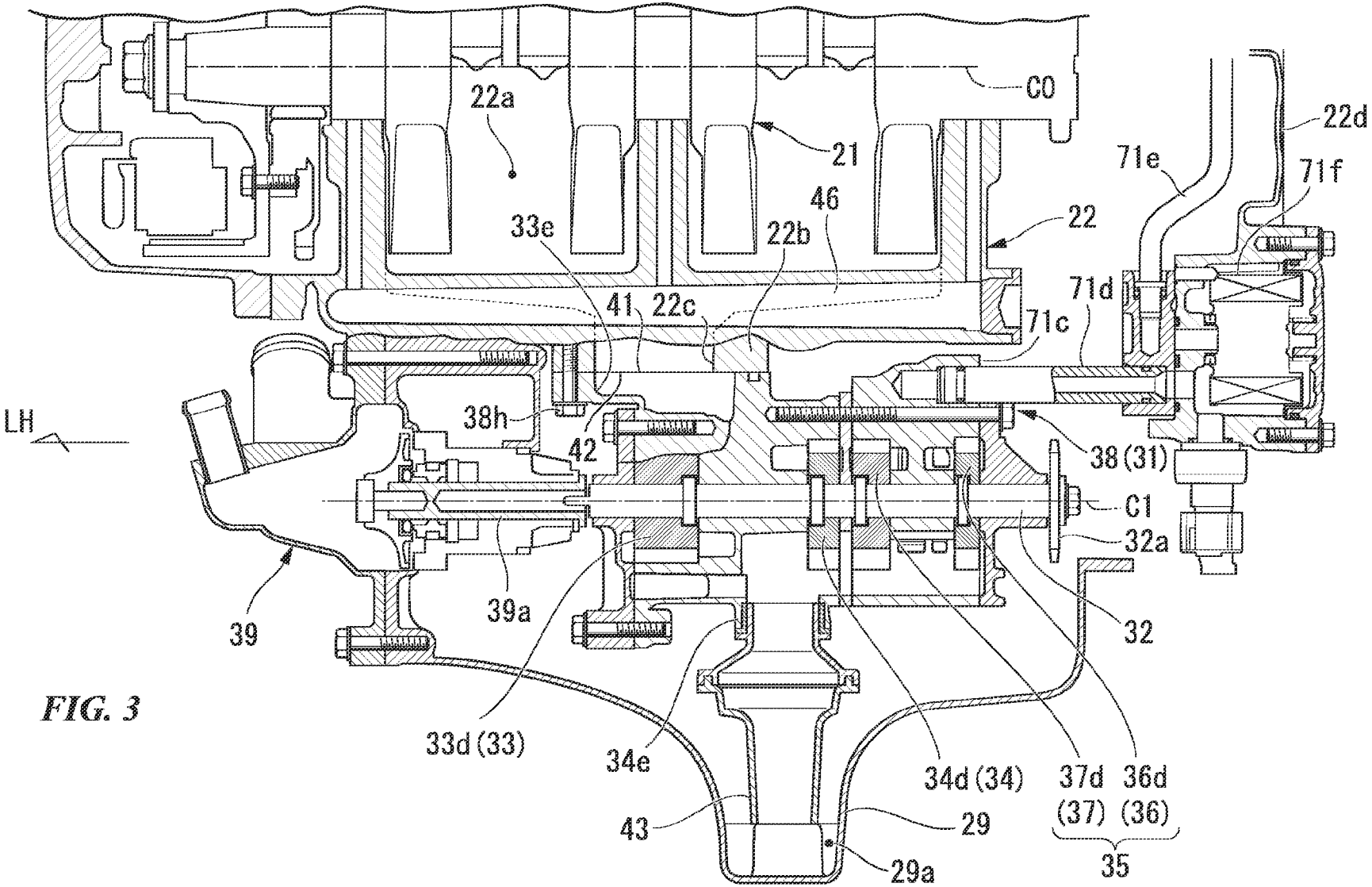
FIG. 3 is a cross-sectional view orthogonal to the front-and-rear direction of main parts of the engine.
Figure 4:
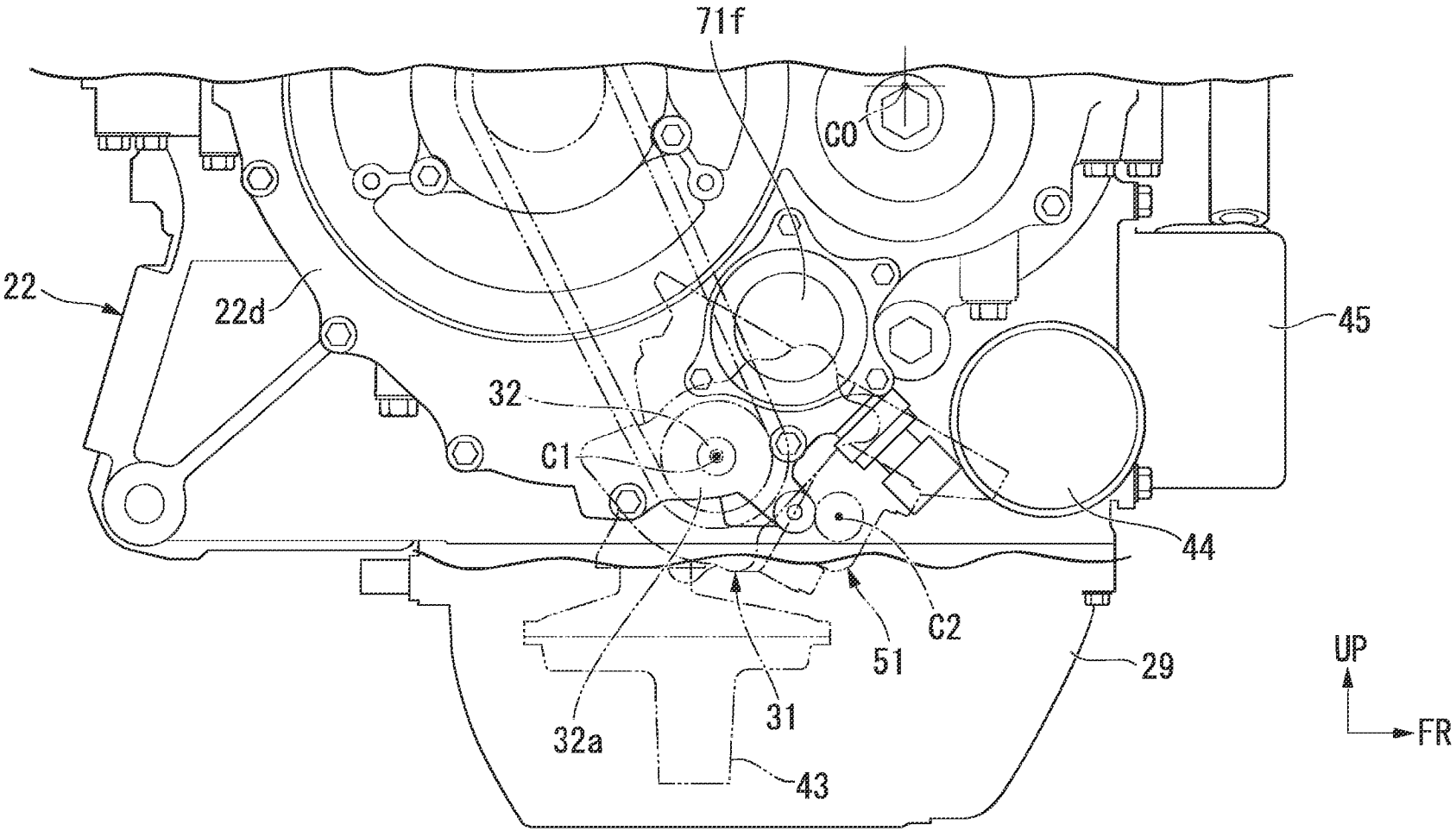
FIG. 4 is a right side view of the main parts of the engine.

Referring to FIGS. 2 to 4, the oil pump unit 31 is attached to the inside of the lower portion of the crankcase 22, and is driven with the rotation of a rotating member (the crankshaft 21 or an outer clutch of a multiple-disc clutch to which the rotative power of the crankshaft is always transmitted, or the like) that always rotates during the operation of the engine 13.

The oil pump unit 31 has a pump drive shaft (hereinafter simply referred to as drive shaft) 32 parallel to the crankshaft 21. A driven member 32*a* (for example, driven sprocket) for interlocking with the rotating member is integrally rotatably attached to a right end portion of the drive shaft 32. In the drawings, reference numeral C1 represents the rotation center axis of the drive shaft 32.

Referring to FIG. 3, the oil pump unit 31 has a configuration in which an oil pump that is an internal gear pump of a plurality of trochoid teeth forms is arranged along the right-and-left direction. The oil pump unit 31 has a configuration in which a scavenge pump 33, a feed pump 34, and a pump for control 35 that generates oil pressure for controlling devices, such as the transmission 27 and a power valve system, are coaxially arranged in order from left to right.

The oil pump unit 31 has a single pump body 38 and the drive shaft 32 that are shared by the respective pumps 33, 34, and 35. A right end portion of the drive shaft 32 protrudes from a right end of the pump body 38, and the driven member 32*a* is integrally rotatably attached to this right end portion.

A left end portion of the drive shaft 32 protrudes from a left end of the pump body 38, and a right end portion of a drive shaft 39*a* of a water pump 39 is integrally rotatably engaged with this left end portion. The drive shaft 39*a* of the water pump 39 is arranged along the right-and-left direction, and the drive shaft 39*a* is arranged coaxially with the drive shaft 32 of the oil pump unit 31.

Figure 6:
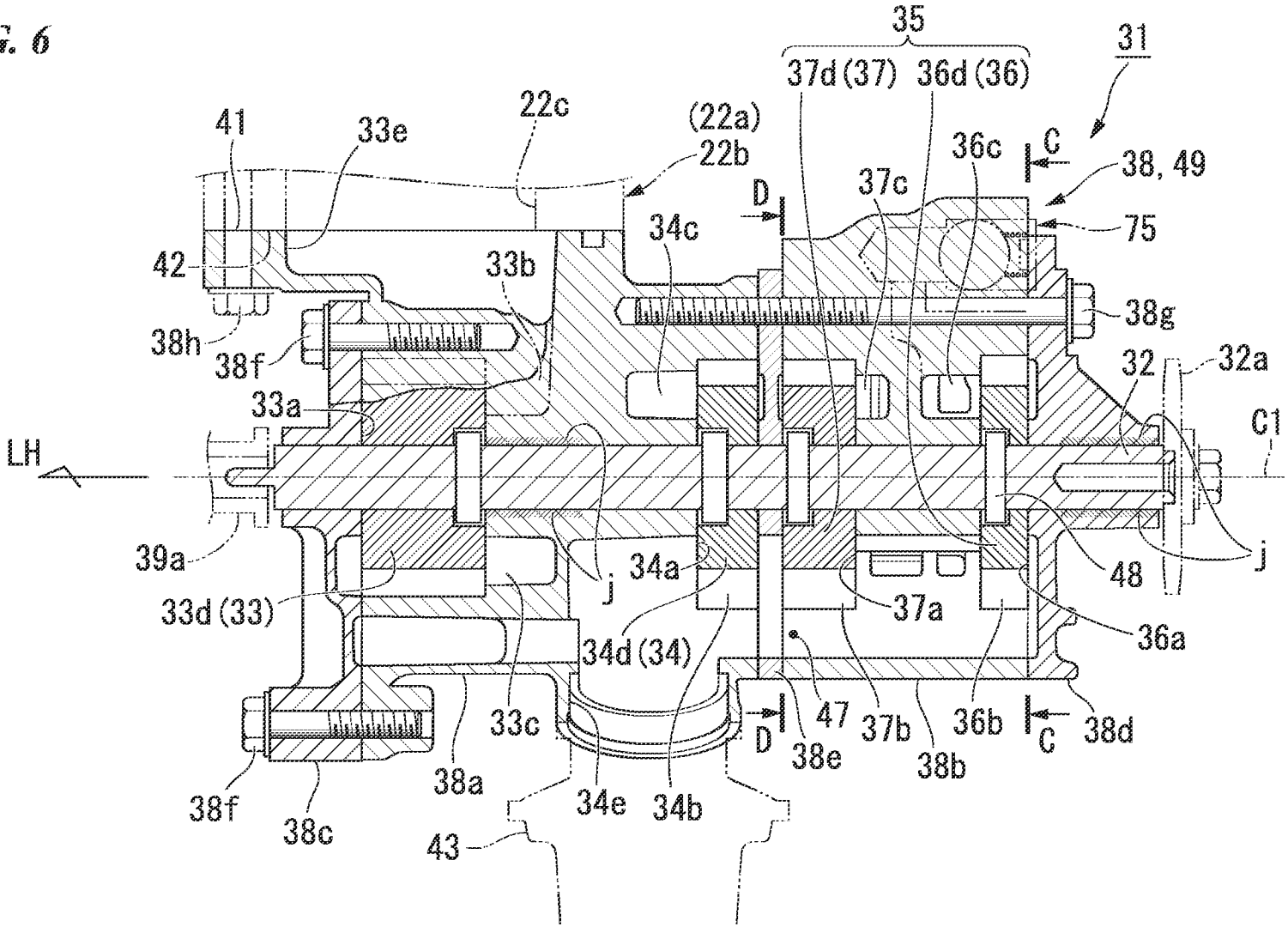
FIG. 6 is a cross-sectional view taken along line A-A of FIG. 5.

As shown in FIG. 6, the pump body 38 is split into a left split body 38*a* that forms rotor accommodation portions 33*a* and 34*a*, suction ports 33*b* and 34*b*, and discharge ports 33*c* and 34*c* of the scavenge pump 33 and the feed pump 34, a right split body 38*b* (member) that forms rotor accommodation portions 36*a* and 37*a*, suction ports 36*b* and 37*b*, and discharge ports 36*c* and 37*c* of a main oil pump 36 (main pump section) and a subsidiary oil pump 37 (subsidiary pump section) which are described below in the pump for control 35, a left lid body 38*c* that blocks a left end of the left split body 38*a*, a right lid body 38*d* (member) that block a right end of the right split body 38*b*, and a partition plate 38*e* sandwiched between the left and right split bodies 38*a* and 38*b*.

The left lid body 38*c* is fastened and fixed to the left end of the left split body 38*a* by a plurality of bolts 38*f*, and the right lid body 38*d* is fastened and fixed to the right end of the left split body 38*a* by a plurality of elongated bolts 38*g* that pass through the right split body 38*b* and the partition plate 38*e*. Thereby, each of the split bodies 38*a* and 38*b*, each of the lid bodies 38*c* and 38*d*, and the partition plate 38*e* are integrally combined.

A pump rotor 34*d* of the feed pump 34 is accommodated in the rotor accommodation portion 34*a*, and a pump rotor 33*d* of the scavenge pump 33 is accommodated in the rotor accommodation portion 33*a*. Each of the pump rotors 33*d* and 34*d* has a well-known configuration including an outer rotor and an inner rotor. The inner rotor of each of the pump rotors 33*d* and 34*d* is made to be integrally rotatable with the drive shaft 32 held by a central portion of the pump body 38.

The drive shaft 32 has a right end portion rotatably supported by the right lid body 38*d* on the right side thereof and has a left side portion rotatably supported not by the left lid body 38*c* but by a hub portion of the left split body 38*a* on the left side thereof. Thereby, the distance between rotatably supported parts is shortened to suppress deflection of a shaft intermediate portion to reduce vibration. In addition, reference numeral j in the drawings represents the rotatably supporting parts of the drive shaft 32 in the pump body 38.

Figure 5:
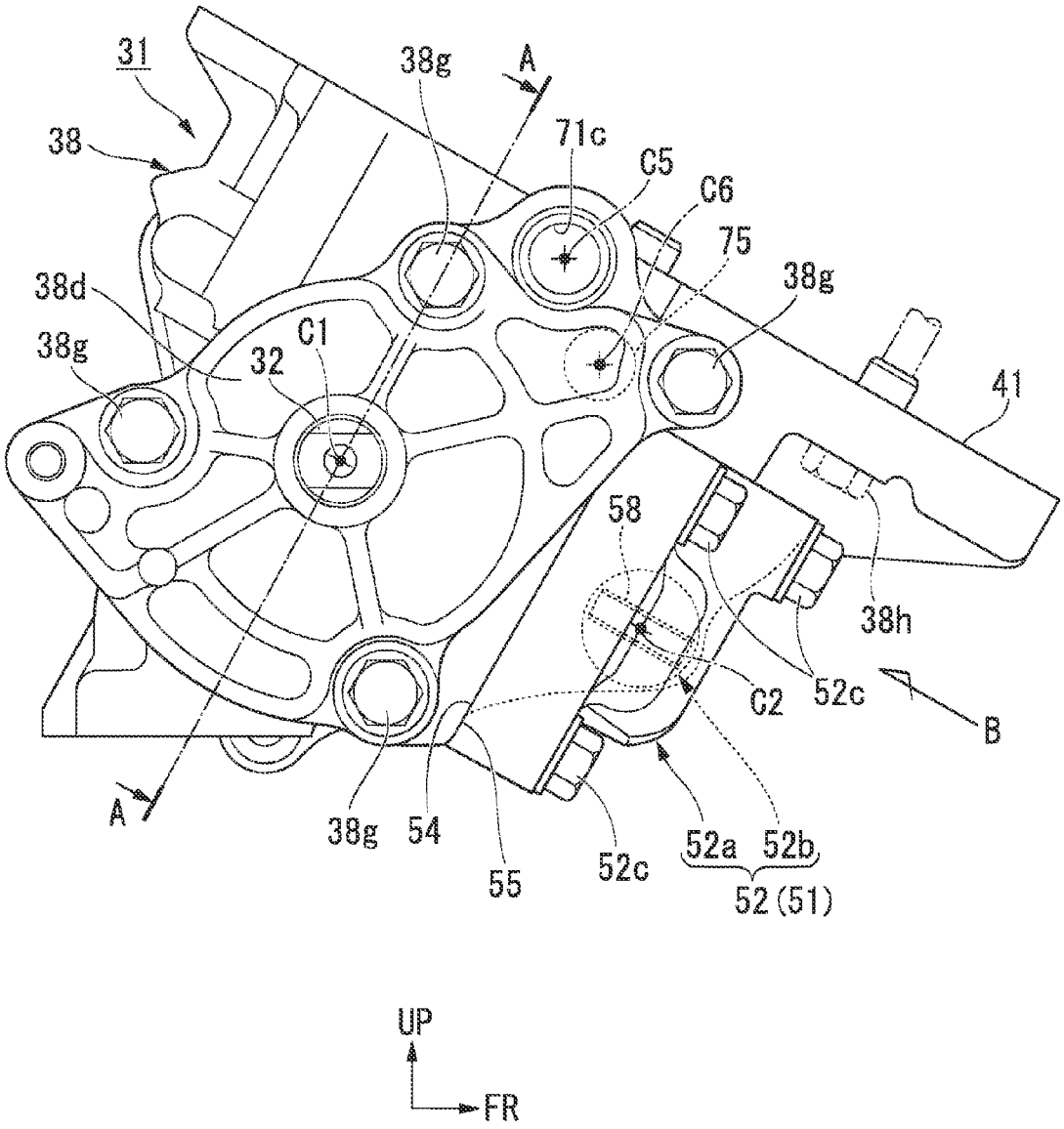
FIG. 5 is a right side view of an oil pump unit of the engine.

Referring to FIG. 5 together, an upper left portion of the pump body 38 is formed with an engine attachment surface 41 that inclines forward and downward in a state where the oil pump unit 31 is attached to the crankcase 22. The engine attachment surface 41 forms a flat shape along the right-and-left direction, and a pump attachment surface 42 that faces the engine attachment surface 41 is formed at a lower portion of a bottom wall 22*b* of a crank chamber 22*a* in the crankcase 22.

Referring to FIGS. 2 and 3, the pump body 38 (oil pump unit 31) is fastened and fixed to the bottom wall 22*b* of the crank chamber 22*a* by a plurality of bolts 38*h* in a state where the engine attachment surface 41 is made to abut against the pump attachment surface 42 in an oil-tight manner.

Hereinafter, the front-and-rear direction parallel to the engine attachment surface 41 and the pump attachment surface 42 in the oil pump unit 31 may be referred to as a pump front-and-rear direction, and the up-and-down direction orthogonal to the engine attachment surface 41 and the pump attachment surface 42 may be referred to as a pump up-and-down direction.

Figure 7:
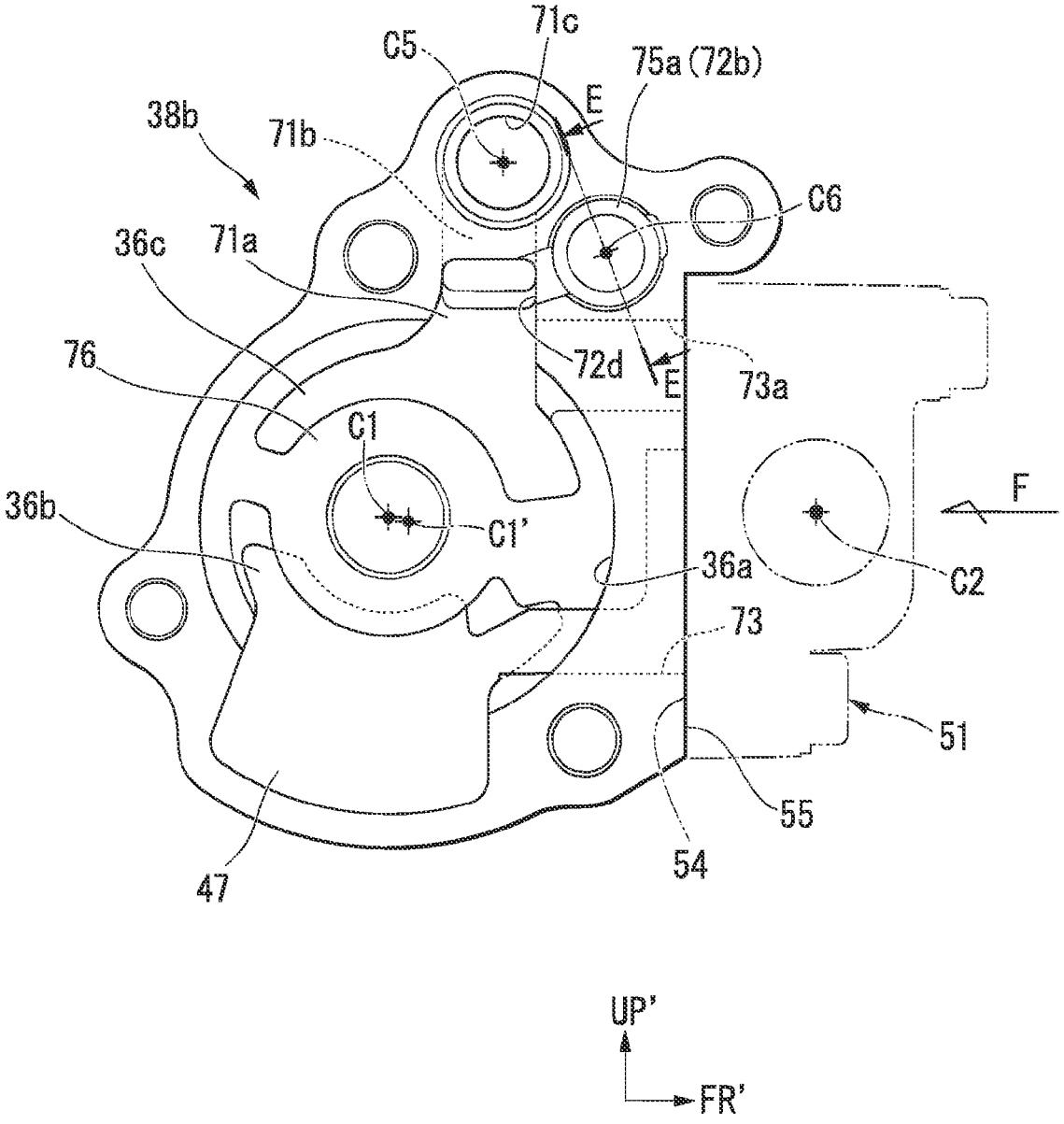
FIG. 7 is a cross-sectional view taken along line C-C of FIG. 6.
Figure 8:
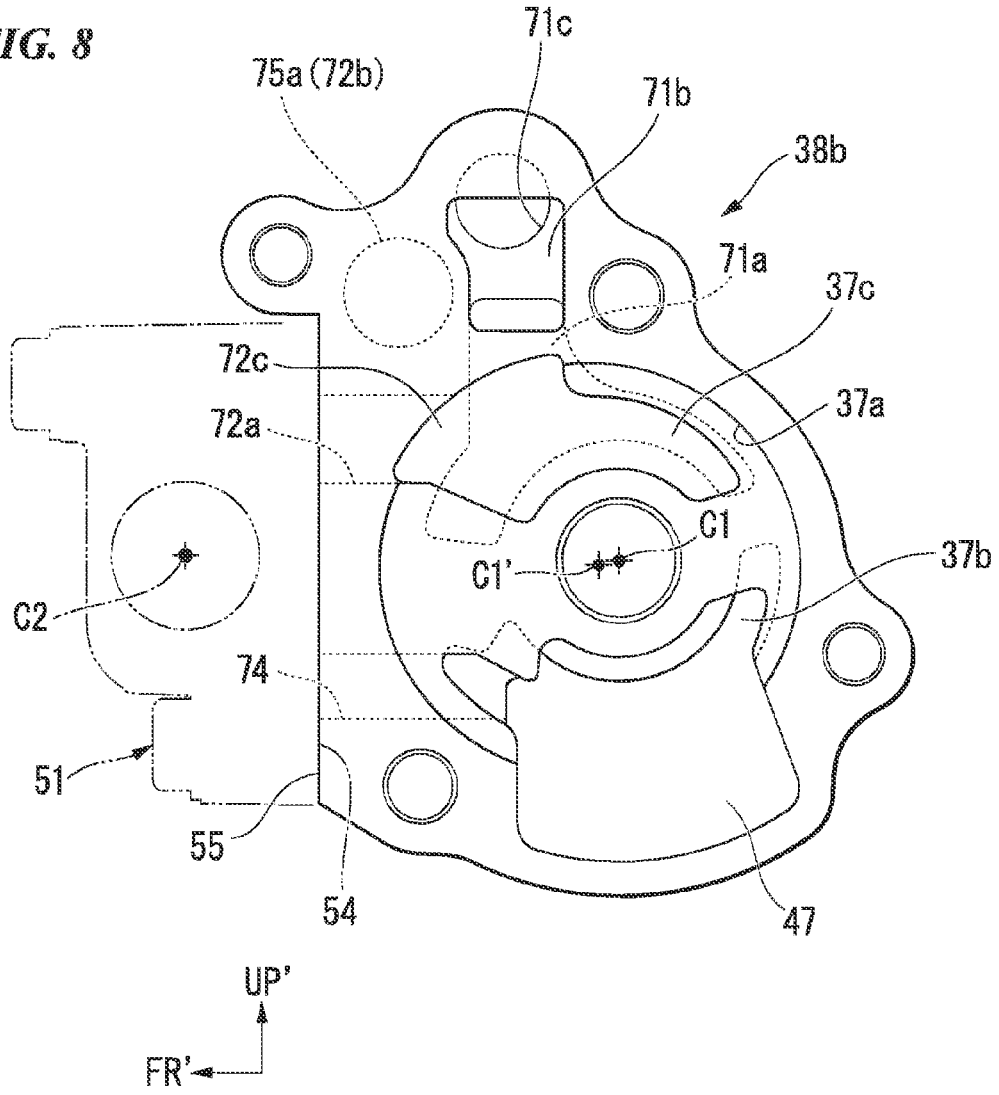
FIG. 8 is a cross-sectional view taken along line D-D of FIG. 6.

In FIGS. 7 and 8 to be referred to below, arrow FR' indicates the front (pump front) in the pump front-and-rear direction, and arrow UP' in the drawings indicates the upside (pump upside) in the pump up-and-down direction.

Referring to FIG. 6, the suction port 33*b* of the scavenge pump 33 is formed on the upper left side of the left split body 38*a*. In the suction port 33*b*, a suction opening 33*e* opens on the engine attachment surface 41 above the suction port. An opening 22*c* is formed in the pump attachment surface 42 of the bottom wall 22*b* of the crank chamber 22*a* so as to face the suction opening 33*e*.

The suction opening 33*e* and the opening 22*c* communicate with each other in a state where the oil pump unit 31 is attached to the crankcase 22.

The discharge port 33*c* of the scavenge pump 33 that opens to an oil pan chamber 29*a* is formed on the lower right side of the left split body 38*a*. The scavenge pump 33 suctions the oil within the crank chamber 22*a* from the suction port 33*b* during the driving of the oil pump unit 31, and discharges this oil from the discharge port 33*c* to return the oil to the oil pan chamber 29*a*.

The discharge port 34*c* that communicates with oil supply passages of the feed pump 34 to the respective parts of the engine 13 is formed on the upper right side of the left split body 38*a*. During the driving of the oil pump unit 31, the feed pump 34 suctions the oil within the oil pan chamber 29*a* from the suction port 34*b* via a strainer 43, and discharges this oil from the discharge port 34*c* to pump the oil to the respective parts of the engine 13.

Referring to FIGS. 3 and 4, the oil discharged by the feed pump 34 reaches a main oil gallery 46 via, for example, an oil filter 44 and an oil cooler 45, and is then supplied to oil supply locations of the respective parts of the engine 13. A suction opening 34*e* that is connected to the strainer 43 opens below the suction port 34*b* of the feed pump 34.

Referring to FIG. 6, a communication space portion 47 that extends right and left, including the suction port 34*b* of the feed pump 34 and the respective suction ports 36*b* and 37*b* of the main oil pump 36 and the subsidiary oil pump 37 of the pump for control 35, is formed within a lower portion of the pump body 38. The communication space portion 47 is immersed in the oil within the oil pan 29.

The feed pump 34, the main oil pump 36, and the subsidiary oil pump 37 suctions the oil which is introduced into the communication space portion 47 via the strainer 43, from the respective suction ports 34*b*, 36*b*, and 37*b*.

The strainer 43 is arranged so as to protrude downward from a right-and-left intermediate portion of the pump body 38, and the right-and-left intermediate portion of the oil pan 29 is formed to protrude downward so as to receive the strainer 43 (refer to FIG. 3).

The main oil pump 36 and the subsidiary oil pump 37 are arranged so as to line up in the direction along the drive shaft 32 (the right-and-left direction; hereinafter referred to as pump axis direction). The main oil pump 36 always communicates with the oil supply passages that lead to oil pressure supply destinations (the devices). The subsidiary oil pump 37 switches a communication state with the oil supply passages by the operation of the oil passage-switching valve 51 (oil pressure-adjusting valve) to be described below.

The main oil pump 36 accommodates a pump rotor 36*d* in the rotor accommodation portion 36*a* on the right side of the right split body 38*b*, and the subsidiary oil pump 37 accommodates a pump rotor 37*d* in the rotor accommodation portion 37*a* on the left side of the right split body 38*b*.

The main oil pump 36 is arranged further outside the pump body 38 in the pump axis direction than the subsidiary oil pump 37. The driven member 32*a* is arranged outside the main oil pump 36 in the pump axis direction.

Both the respective suction ports 36*b* and 37*b* of the main oil pump 36 and the subsidiary oil pump 37 open to the communication space portion 47. The respective discharge ports 36*c* and 37*c* of the main oil pump 36 and the subsidiary oil pump 37 individually open at the upper portion of the pump body 38. The main oil pump 36 and the subsidiary oil pump 37 constitute a pump assembly 49 that forms a portion of the oil pump unit 31.

The pump rotors 36*d* and 37*d* of the main oil pump 36 and the subsidiary oil pump 37 have a well-known configuration including an outer rotor and an inner rotor, respectively. The inner rotor of each of the pump rotors 36*d* and 37*d* is made to be integrally rotatable with the drive shaft 32. The width (thickness) of the pump rotor 37*d* of the subsidiary oil pump 37 in the pump axis direction is made to be larger than that of the pump rotor 36*d* of the main oil pump 36.

The pump rotors 36*d* and 37*d* are made to have substantially the same diameter as each other. The number of teeth of the inner rotor of the pump rotor 36*d* of the main oil pump 36 is set to eight and the number of teeth of the inner rotor of the pump rotor 37*d* of the subsidiary oil pump 37 is set to four. The theoretical discharge rate per rotation of the subsidiary oil pump 37 (pump capacity) is set to about 1.25 to 1.8 times that of the main oil pump 36.

The main oil pump 36 and the subsidiary oil pump 37 are driven in mutually different cycles of discharge rates with phase differences, thereby suppressing occurrence of pulsation of a lubrication system.

Figure 15:
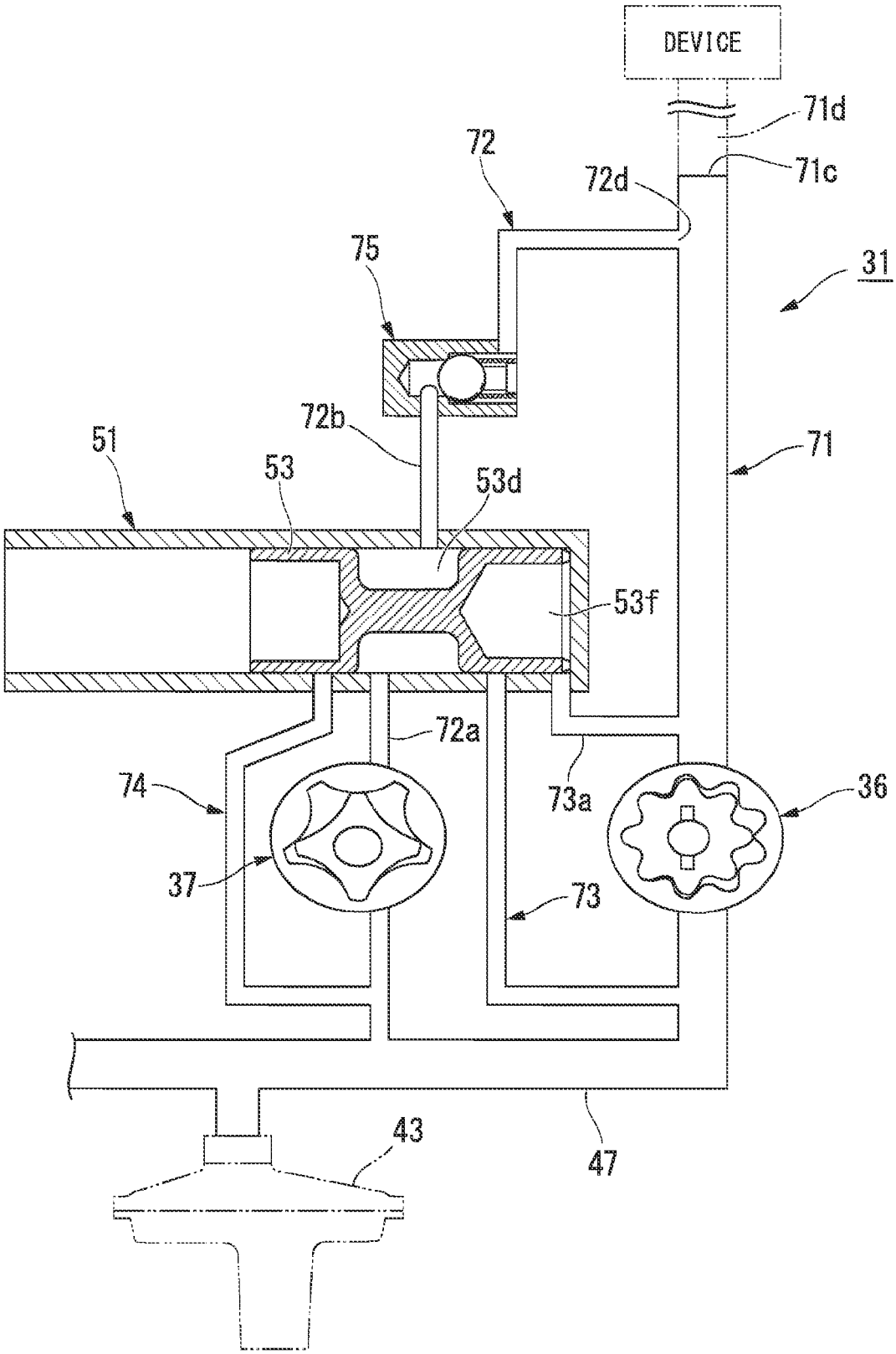
FIG. 15 is a configuration view showing the outline of the oil pump unit.

The oil pump unit 31 (variable flow rate oil pump) including the main oil pump 36, the subsidiary oil pump 37 (pump assembly 49), and the oil passage-switching valve 51 will be described with reference to FIG. 15.

The oil pump unit 31 has a main discharge passage 71 that extends from the discharge port 36*c* of the main oil pump 36, a subsidiary discharge passage 72 that extends from the discharge port 37*c* of the subsidiary oil pump 37 and joins the main discharge passage 71 via the oil passage-switching valve 51, a subsidiary relief passage 74 that extends from the oil passage-switching valve 51 to the suction side of the subsidiary oil pump 37, a main relief passage 73 that extends from the oil passage-switching valve 51 to the suction side of the main oil pump 36 separately from the subsidiary relief passage 74, and a check valve 75 that is provided on the downstream side of the oil passage-switching valve 51 in the subsidiary discharge passage 72 and cuts off the flow of oil from the main discharge passage 71 side to the oil passage-switching valve 51 side.

The subsidiary discharge passage 72 is split into an upstream subsidiary discharge passage 72*a* that is interposed between the subsidiary oil pump 37 and the oil passage-switching valves 51, and a downstream subsidiary discharge passage 72*b* that is interposed between the oil passage-switching valve 51 and a joining portion 72*d* of the subsidiary discharge passage 72 and the main discharge passage 71.

The oil passage-switching valve 51 has a main pressure-adjusting chamber 53*f* that is formed within a valve body 52 for adjusting the discharge rate of the main oil pump 36, a subsidiary pressure-adjusting chamber 53*d* that is formed within a valve body 52 for adjusting the discharge rate of the subsidiary oil pump 37, and a spool valve 53 (valve body) that is slidably inserted through the valve body 52 in the axial direction and performs partitioning between the main pressure-adjusting chamber 53*f* and the subsidiary pressure-adjusting chamber 53*d* in an oil-tight manner.

The main pressure-adjusting chamber 53*f* is formed on one side of the spool valve 53 in the axial direction, and the subsidiary pressure-adjusting chamber 53*d* is formed around an axial intermediate portion of the spool valve 53.

An upstream main relief passage 73*a* branches from the upstream side of the joining portion 72*d* of the main discharge passage 71 that is joined to the subsidiary discharge passage 72, and the upstream main relief passage 73*a* is connected to the main pressure-adjusting chamber 53*f* of the oil passage-switching valve 51.

The main relief passage 73 and the upstream main relief passage 73*a* communicate appropriately with the main pressure-adjusting chamber 53*f*, and the subsidiary discharge passage 72 and the subsidiary relief passage 74 communicate appropriately with the subsidiary pressure-adjusting chamber 53*d*.

The oil passage-switching valve 51 makes the spool valve 53 stroke, and thereby changes to a first aspect (refer to FIG. 12) in which oil pressure is allowed to be supplied from both the main discharge passage 71 and the subsidiary discharge passage 72 to oil pressure supply destinations, a second aspect (refer to FIG. 13) in which oil pressure is allowed to be supplied only from the main discharge passage 71 to oil pressure supply destinations, and the oil pressure of the subsidiary discharge passage 72 is allowed to be relieved from the subsidiary relief passage 74 to the suction side of the subsidiary oil pump 37, and a third aspect (refer to FIG. 14) in which a portion of the oil pressure of the main discharge passage 71 is allowed to be relieved from the main relief passage 73 to the suction side of the main oil pump 36, further from the second aspect.

In the above third aspect, a portion of the oil pressure of the main discharge passage 71 is relieved independently from the subsidiary relief passage 74 by being guided from the main pressure-adjusting chamber 53*f* to the main relief passage 73. The relief oil returned to the pump suction side from the respective relief passages 73 and 74 is again suctioned and discharged to the main oil pump 36 and the subsidiary oil pump 37.

Hereinafter, the front and rear and the up and down in the description that refers to FIGS. 7 and 8 correspond to the pump front-and-rear direction and the pump up-and-down direction, respectively.

Referring to FIGS. 7 and 8, the respective suction ports 36*b* and 37*b* of the main oil pump 36 and the subsidiary oil pump 37 continue integrally to the upper side of the communication space portion 47 formed in a lower portion of the right split body 38*b*. The respective suction ports 36*b* and 37*b* are formed in a circular-arc shape in cross-sectional views of FIGS. 7 and 8 so as to run along a lower outer periphery of a cylindrical hub portion 76 of the right split body 38*b* through which the drive shaft 32 is inserted.

The main relief passage 73 and the subsidiary relief passage 74 that extend from the engine attachment surface 41 are individually connected to front end portions of the respective suction ports 36*b* and 37*b*. The inner rotors of the respective pump rotors 36*d* and 37*d* share the center axis C1 of the drive shaft 32. Reference numeral C1' in the drawings represents the center axis of outer rotors of the respective pump rotors 36*d* and 37*d*.

The discharge port 36*c* of the main oil pump 36 is recessed so as to open to the right on a right side surface of the right split body 38*b*, and the discharge port 37*c* of the subsidiary oil pump 37 is recessed so as to open to the left on a left side surface of the right split body 38*b*. The respective discharge ports 36*c* and 37*c* are formed in a circular-arc shape in cross-sectional views of FIGS. 7 and 8 so as to run along an upper outer periphery of the hub portion 76.

A discharge space portion 71*a* that protrudes upward in cross-sectional views of FIGS. 7 and 8 is formed on the upper rear side of the discharge port 36*c* of the main oil pump 36. A discharge passage portion 71*b* that makes a discharge port 71*c* open on an upper portion of the right side surface of the right split body 38*b* continues to the discharge space portion 71*a*.

Referring to FIG. 3 together, the discharge port 71*c* opens toward the right, in the rear of and above the drive shaft 32, and a base end portion (left end portion) of a first piping 71*d* that runs along right-and-left direction is connected to the discharge port 71*c*.

A leading end portion (right end portion) of the first piping 71*d* is connected to an inflow port of a second oil filter 71*f* arranged on a right engine cover 22*d*. The oil that has passed through the second oil filter 71*f* is supplied to oil pressure supply destinations (devices) through a second piping 71*e* or the like that extends upwards from an outflow port of the second oil filter 71*f*. Reference numeral C5 in the drawings represents the center axis of the discharge port 71*c* along the right-and-left direction.

The upstream main relief passage 73*a* branches from the discharge space portion 71*a*, and the upstream main relief passage 73*a* leads to a valve attachment surface 55. The upstream main relief passage 73*a* also forms a portion of the main relief passage 73, and also supplies the oil pressure for operating the spool valve 53 to the oil passage-switching valve 51.

The oil passage-switching valve 51 displaces the spool valve 53 according to the oil pressure supplied from the upstream main relief passage 73*a*, switches the communication state of the upstream subsidiary discharge passage 72*a*, the downstream subsidiary discharge passage 72*b*, and the subsidiary relief passage 74, and switches the communication state of the respective main relief passages 73 and 73*a*.

An overhanging space portion 72*c* that overhangs rearward and upward in cross-sectional views of FIGS. 7 and 8 is formed on an upper rear side of the discharge port 37*c* of the subsidiary oil pump 37. The upstream subsidiary discharge passage 72*a* extends from the overhanging space portion 72*c*, and the upstream subsidiary discharge passage 72*a* leads to the valve attachment surface 55.

After the oil pressure of the subsidiary oil pump 37 has reached the oil passage-switching valve 51 through the upstream subsidiary discharge passage 72*a*, the oil pressure joins the oil pressure of the main discharge passage 71 through the downstream subsidiary discharge passage 72*b* or is returned to the suction side of the subsidiary oil pump 37 through the subsidiary relief passage 74, according to the operation of the oil passage-switching valve 51.

Figure 9:
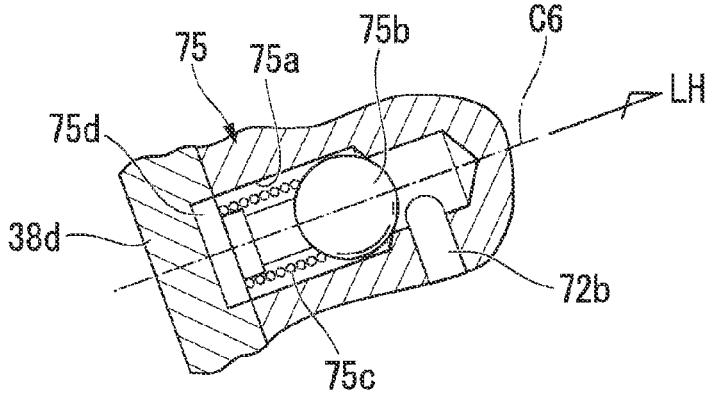
FIG. 9 is a cross-sectional view taken along line E-E of FIG. 7.

Referring to FIG. 9, the check valve 75 of the downstream subsidiary discharge passage 72*b* permits the flow of oil from the upstream side (oil passage-switching valve 51 side) to the downstream side (joining portion 72*d* side), and cuts off the flow of oil in the reverse direction.

The check valve 75 has a valve accommodation portion 75*a* that forms a portion of the downstream subsidiary discharge passage 72*b*, a steel ball 75*b* as a valve body that is accommodated within the valve accommodation portion 75*a*, and a compression coil spring (hereinafter referred to as coil spring) 75*c* that biases the steel ball 75*b* in order to cut off the downstream subsidiary discharge passage 72*b*.

The end portion of the coil spring 75*c* opposite the steel ball 75*b* is held by the right lid body 38*d* via a spring sheet 75*d*. In other words, the check valve 75 is sandwiched between the right split body 38*b* and the right lid body 38*d*.

The valve accommodation portion 75*a* forms a stepped cylindrical shape that has a larger diameter on the downstream side than on the upstream side, and the steel ball 75*b* is pressed against the stepped portion of the valve accommodation portion 75*a* by the biasing force of the coil spring 75*c* from the downstream side.

Thereby, if a pressing force caused by an oil pressure of the upstream side against the steel ball 75*b* exceeds the total of a pressing force by an oil pressure of the downstream side and a biasing force of the coil spring 75*c*, a gap is formed between the steel ball 75*b* and the stepped portion, and the oil of the upstream side flows to the downstream side.

On the other hand, when the oil pressure of the downstream side is higher than the oil pressure of the upstream side, the steel ball 75*b* is pressed against the stepped portion and the flow of oil from the downstream side to the upstream side is cut off. Reference numeral C6 in the drawings represents the center axis of the check valve 75 (valve accommodation portion 75*a*) along the right-and-left direction.

Figure 11:
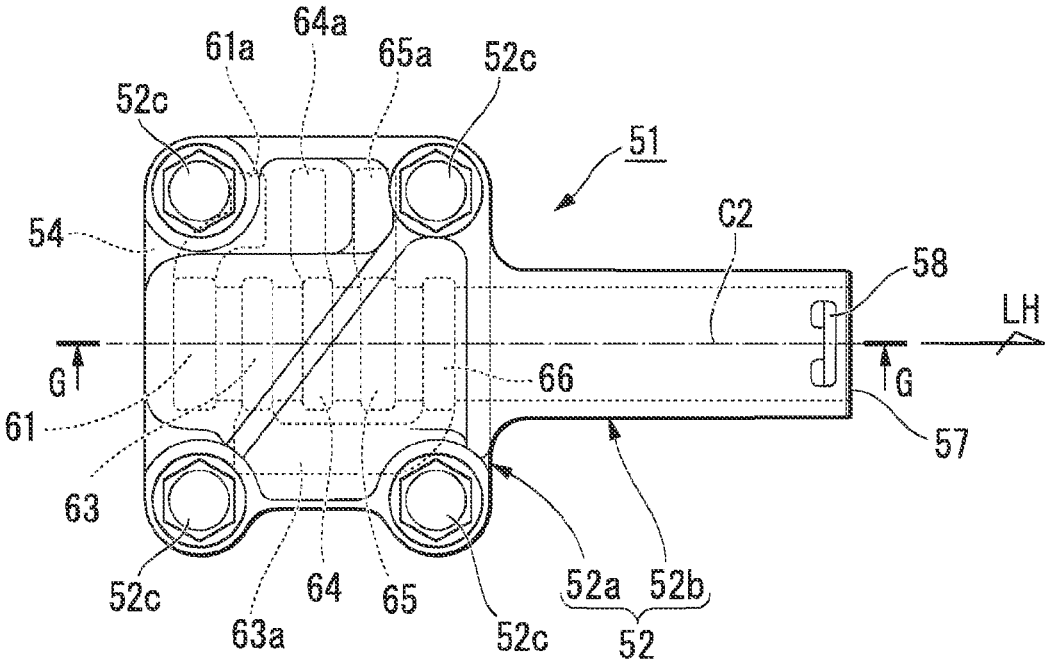
FIG. 11 is a view as seen in the direction of arrow B of FIG. 5.
Figure 12:
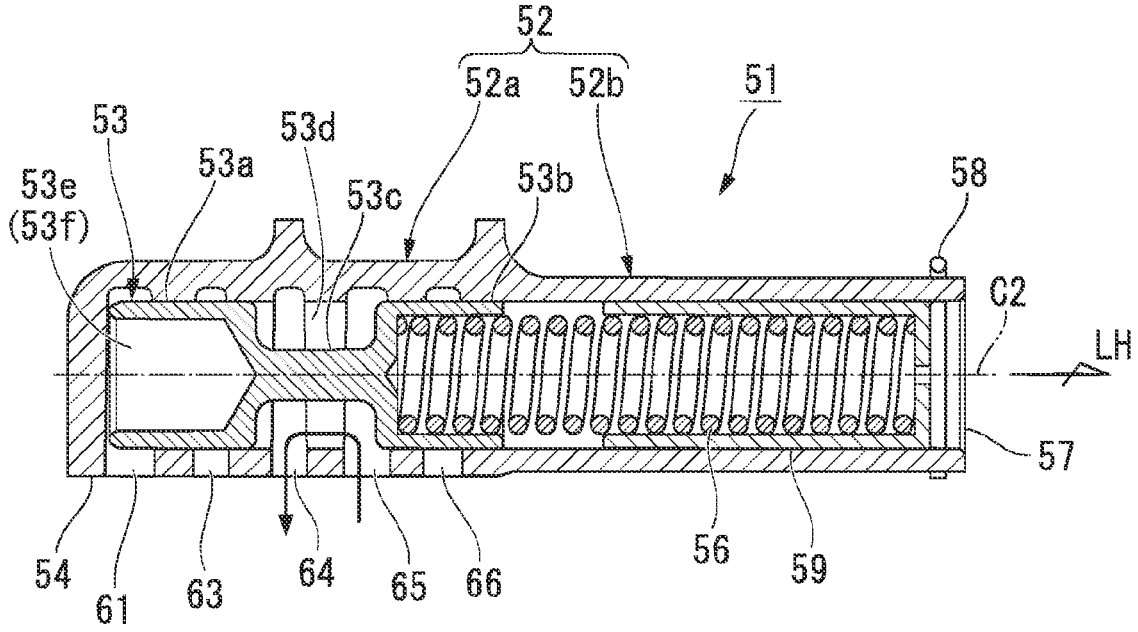
FIG. 12 is a cross-sectional view taken along line G-G of FIG. 11.

Referring to FIGS. 5, 11, and 12, the oil passage-switching valve 51 is attached to the front lower side of the pump body 38 in a state where the longitudinal direction is made to run along the right-and-left direction. Reference numeral C2 in the drawings represents the center axis of the oil passage-switching valve 51. The oil passage-switching valve 51 has the valve body 52 that forms a cylindrical sleeve (valve insertion hole) along the axis C2, and the spool valve 53 that is inserted into a sleeve of the valve body 52.

A body attachment surface 54 that inclines rearward and downward in the state of attachment to the engine 13 is formed on the upper rear side of a right portion (oil passage forming portion 52*a* to be described below) of the valve body 52.

The body attachment surface 54 forms a flat shape along the right-and-left direction, and the body attachment surface 54 abuts against the valve attachment surface 55 formed on the front lower side of the valve body 52 in an oil-tight manner. In this state, the valve body 52 is fastened and fixed to the pump body 38 by a plurality of bolts 52*c*.

A left end of the valve body 52 is formed as an opening 57, and the spool valve 53 and a compression coil spring (hereinafter referred to as coil spring) 56 that biases this spool valve to the right are inserted into the valve body 52 from the opening 57.

A fixing pin 58 that passes through the valve body in the radial direction is attached to the left end of the valve body 52. A left end (bottom face) of a bottomed cylindrical spring guide 59 that opens to the right abuts against the right side (the inside of the valve body 52) of the fixing pin 58.

A left portion of the coil spring 56 is inserted into the spring guide 59, and the spring guide 59 that has received the reaction force of the coil spring 56 is biased to the left, and abuts against the fixing pin 58. In this state, the coil spring 56 is compressed by a predetermined amount.

Here, referring to FIG. 5, in a state where the valve body 52 is attached to the pump body 38, the left end portion of the valve body 52 is close to a wall portion of the pump body 38, and is arranged so that the coming-off direction of the fixing pin 58 faces the valve body 52 side, and a wall portion of a fastening boss or the like of the pump body 38 is close to the left of the left end of the valve body 52. Thereby, jumping-out of the coil spring 56 or the like is reliably regulated with a simple configuration.

Additionally, referring to FIG. 2, the oil passage-switching valve 51 is arranged so as to be located below an oil level (reference numeral OH indicates an upper limit level and reference numeral OL indicates a lower limit level, respectively.) within a lower portion of the crankcase 22. By immersing the oil passage-switching valve 51 within oil in this way, a damper effect that relaxes the behavior of the spool valve 53 is obtained.

Referring to FIGS. 11 and 12, the right side portion of the valve body 52 is formed as a rectangular parallelepiped-shaped oil passage forming portion 52*a* that switches an oil passage by movement of the spool valve 53. The left side portion of a valve body 52 is formed as a cylindrical storage portion 52*b* that mainly stores the coil spring 56.

A valve insertion hole within the valve body 52 is formed over the insides of the oil passage forming portion 52*a* and the storage portion 52*b*. The coil spring 56 and the spring guide 59 are inserted through the inside of the storage portion 52*b*.

The spring guide 59 also functions as a stopper that specifies a movement stopping position to the left of the spool valve 53. By providing the spring guide 59 separately from the spool valve 53, the valve following performance resulting from the reduction in weight of the spool valve 53 is improved compared to a case where these spring guide and spool valve are integrated.

A first introduction port 61, a first return port 63, a second lead-out port 64, a second introduction port 65, and a second return port 66 are respectively formed in an annular groove shape in order from right to left in the inner peripheral surface of the valve insertion hole within the oil passage forming portion 52*a*.

The first introduction port 61 communicates with the discharge port 36*c* of the main oil pump 36 via the upstream main relief passage 73*a*. The first return port 63 communicates with the suction port 36*b* of the main oil pump 36 via the main relief passage 73.

The second lead-out port 64 communicates with the main discharge passage 71 via the downstream subsidiary discharge passage 72*b*. The second introduction port 65 communicates with the discharge port 37*c* of the subsidiary oil pump 37 via the upstream subsidiary discharge passage 72*a*. The second return port 66 communicates with the suction port 37*b* of the subsidiary oil pump 37 via the subsidiary relief passage 74.

The first introduction port 61, the first return port 63, the second lead-out port 64, the second introduction port 65, and the second return port 66 open in the shape of a slit that extends up and down so as to be orthogonal to the pump axis direction on the body attachment surface 54, respectively.

The first introduction port 61, the second lead-out port 64, and the second introduction port 65 extend so as to continue to a first introduction groove 61*a*, a second lead-out groove 64*a*, and a second introduction groove 65*a* that line up right and left between the bolts 52*c* on the upper side of FIG. 11 on the body attachment surface 54.

The first return port 63 and the second return port 66 extends so as to continue to both right and left end portions of a communication groove 63*a* that extends right and left between the bolts 52*c* on the lower side of FIG. 11 on the body attachment surface 54.

Figure 10:
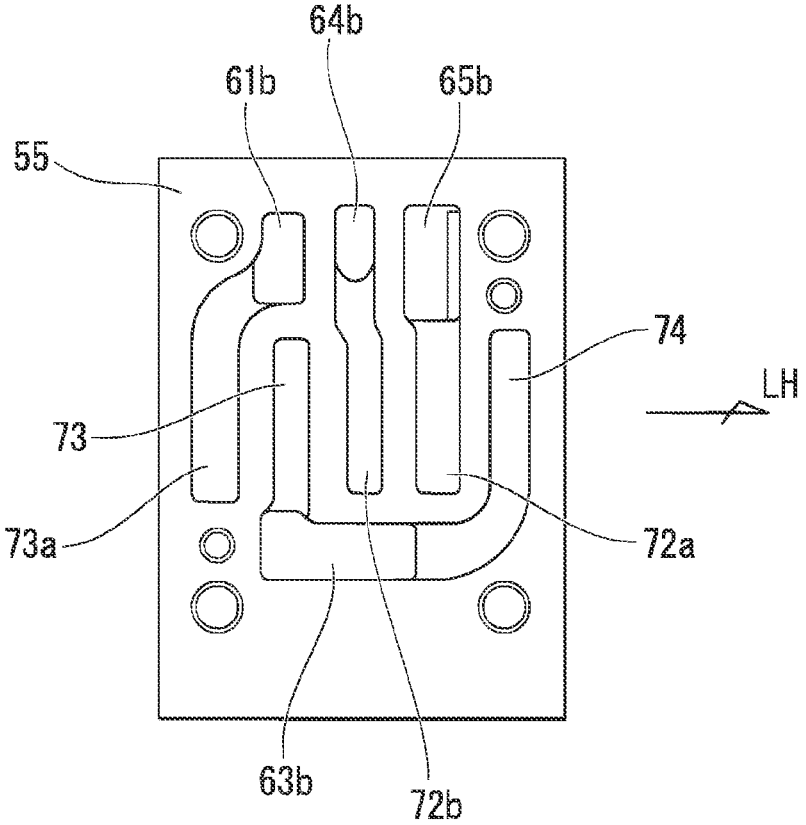
FIG. 10 is a view as seen in the direction of arrow F of FIG. 7.

Referring to FIG. 10, the upstream main relief passage 73*a*, the main relief passage 73, the downstream subsidiary discharge passage 72*b*, the upstream subsidiary discharge passage 72*a*, and the subsidiary relief passage 74 open in the shape of a slit that extends up and down so as to be orthogonal to the pump axis direction in order from right to left, respectively, on the valve attachment surface 55 formed on the front lower side of the pump body 38.

The upstream main relief passage 73*a*, the downstream subsidiary discharge passage 72*b*, and the upstream subsidiary discharge passage 72*a* extend so as to continue to the first introduction groove 61*b*, the second lead-out groove 64*b*, and the second introduction groove 65*b* that line up right and left between the bolts 52*c* on the upper side of FIG. 11 on the valve attachment surface 55.

The main relief passage 73 and the subsidiary relief passage 74 extend so as to continue to both right and left end portions of a communication groove 63*b* that extends right and left between the bolts 52*c* on the lower side of FIG. 11 on the valve attachment surface 55.

The upstream main relief passage 73*a*, the main relief passage 73, the downstream subsidiary discharge passage 72*b*, the upstream subsidiary discharge passage 72*a* and the subsidiary relief passage 74, and the first introduction groove 61*a*, the second lead-out groove 64*a*, the second introduction groove 65*a*, and the communication groove 63*a* on the valve attachment surface 55, correspond to the first introduction port 61, the first return port 63, the second lead-out port 64, the second introduction port 65 and the second return port 66, and the first introduction groove 61*b*, the second lead-out groove 64*b*, the second introduction groove 65*b*, and the communication groove 63*b* on the body attachment surface 54, respectively, and these face each other individually and communicate with each other during attachment of the valve body 52 to the pump body 38.

Referring to FIGS. 11 and 12, a right side portion of the spool valve 53 is formed as a bottomed cylindrical first valve portion 53*a* that opens to the right, the left side portion of the spool valve 53 is formed as a bottomed cylindrical second valve portion 53*b* that opens to the left, and a right-and-left intermediate portion of the spool valve 53 is formed as a throttling portion 53*c* that has a small diameter with respect to the respective valve portions 53*a* and 53*b*. An annular subsidiary pressure-adjusting chamber 53*d* is formed at the outer periphery of the throttling portion 53*c*.

Oil is allowed to circulate between the right end portion of the first valve portion 53*a* and the right bottom portion of the valve body 52 in a state (refer to FIG. 12) where the spool valve 53 has fully moved to the right, and the first introduction port 61 formed at the right end portion of the valve body 52 communicates with this circulation portion.

Thereby, the discharge pressure of the main oil pump 36 is always applied to the inside of the first valve portion 53*a* via the upstream main relief passage 73*a*. The inside of the first valve portion 53*a* is formed as an oil pressure receiving portion 53*e* that always receives the oil pressure from the main oil pump 36.

The spool valve 53 moves to the left against the biasing force of the coil spring 56, according to the magnitude of the oil pressure that the oil pressure receiving portion 53*e* receives. The space that opens to the right of the spool valve 53, including the oil pressure receiving portion 53*e*, becomes the main pressure-adjusting chamber 53*f*.

Referring to FIG. 12, when the spool valve 53 has fully moved to the right, the communication between the first introduction port 61 and the first return port 63 is cut off by the first valve portion 53*a*, and the first return port 63 is blocked by the first valve portion 53*a*. The second lead-out port 64 and the second introduction port 65 communicate with each other via the subsidiary pressure-adjusting chamber 53*d*. The second return port 66 is blocked by the second valve portion 53*b*. This becomes the above first aspect.

Figure 13:
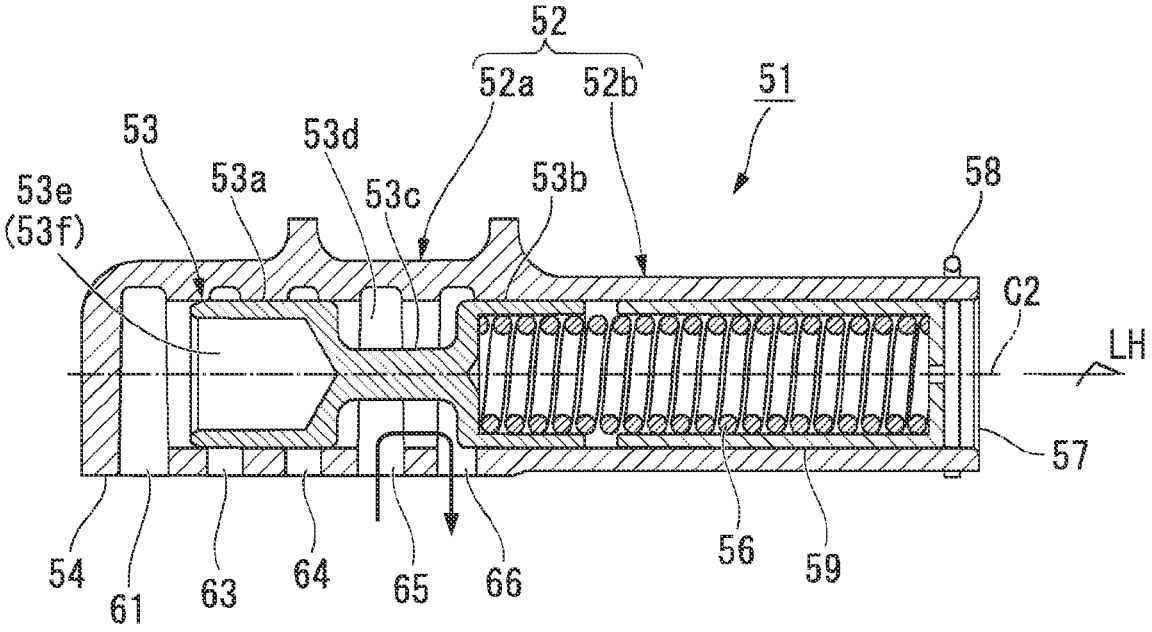
FIG. 13 is a cross-sectional view equivalent to FIG. 12, showing a first action of an oil passage-switching valve shown in FIG. 12.

Referring to FIG. 13, if the spool valve 53 moves to the left by a predetermined amount (such that the spool valve does not move fully to the left), with respect to the first aspect, the second lead-out port 64 is blocked by the first valve portion 53*a*, the second valve portion 53*b* opens the second return port 66, and the second introduction port 65 and the second return port 66 communicate with each other via the subsidiary pressure-adjusting chamber 53*d*. This becomes the above second aspect.

Figure 14:
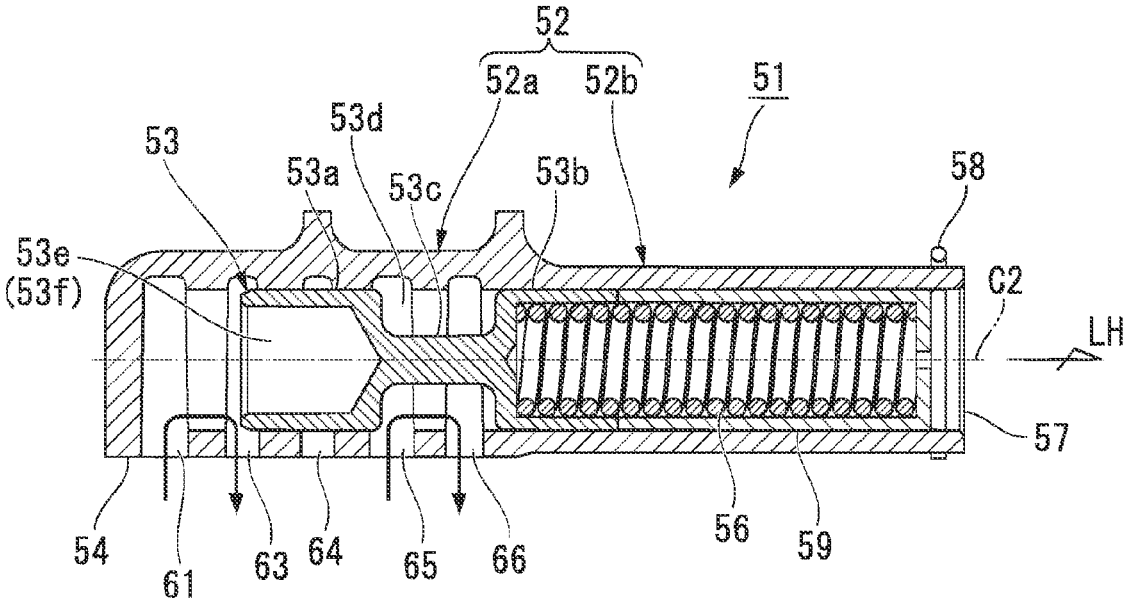
FIG. 14 is a cross-sectional view equivalent to FIG. 12, showing a second action of the oil passage-switching valve.

Referring to FIG. 14, if the spool valve 53 has fully moved to the left, with respect to the second aspect, the first valve portion 53*a* opens the first return port 63. This becomes the above third aspect.

In a state where the rotational speeds of the engine 13 and the oil pump unit 31 are low and the discharge rate of the main oil pump 36 is low, the spool valve 53 is brought into a state where the spool valve does not move to the left but has fully moved to the right (refer to FIG. 12). At this time, the oil pressure of the main oil pump 36 and the subsidiary oil pump 37 is supplied together to devices through the piping 71*d* and 71*e* or the like without being returned to the pump suction side.

From the above state, if the rotational speeds of the engine 13 and the oil pump unit 31 rise and the discharge rate of the main oil pump 36 rises, the spool valve 53 receives this oil pressure and moves to the left by a predetermined amount (refer to FIG. 13). At this time, all the oil pressure from the subsidiary oil pump 37 is returned to the pump suction side, keeping a state where all the oil pressure of the main oil pump 36 is supplied to devices.

Thereafter, if the rotational speeds of the engine 13 and the oil pump unit 31 rise further, the spool valve 53 that receives the discharge pressure of the main oil pump 36 fully moves to the left (refer to FIG. 14). At this time, a portion of the oil pressure from the main oil pump 36 is further returned to the pump suction side as surplus oil pressure, keeping a state where all the oil pressure from the subsidiary oil pump 37 flows back to the suction port 37*b*.

Here, when the spool valve 53 moves to the left, there is a timing at which the second lead-out port 64 (downstream subsidiary discharge passage 72*b*) and the second return port 66 (subsidiary relief passage 74) communicate with the subsidiary pressure-adjusting chamber 53*d* simultaneously.

At this time, if the oil pressure of the main discharge passage 71 flows into the subsidiary relief passage 74 through the downstream subsidiary discharge passage 72*b* and the oil passage-switching valve 51, two types of oil pressures with a difference in height are discharged from the single subsidiary relief passage 74. As a result, the design of an oil pressure adjustment circuit including the oil passage-switching valve 51 will become complicated.

In contrast, in the present embodiment, the downstream subsidiary discharge passage 72*b* is provided with the check valve 75 that cuts off the flow of oil from the main discharge passage 71 side to the oil passage-switching valve 51 side. Thereby, even if the second lead-out port 64 and the second return port 66 communicate with each other via the subsidiary pressure-adjusting chamber 53*d*, the oil pressure of the main discharge passage 71 does not flow into the oil passage-switching valve 51.

Additionally, two types of high and low oil pressures are also not discharged from a single relief passage by separately providing the main relief passage 73 and the subsidiary relief passage 74.

As described above, the engine 13 with the oil pump unit 31 that is the variable flow rate oil pump in the above embodiment includes a main oil pump 36 and a subsidiary oil pump 37 having mutually different discharge rates, and an oil passage-switching valve 51 that adjusts supply oil pressure from the main oil pump 36 and the subsidiary oil pump 37 to oil pressure supply destinations.

The engine has a main discharge passage 71 that extends from the main oil pump 36; a subsidiary discharge passage 72 that extends from the subsidiary oil pump 37 and joins the main discharge passage 71 via the oil passage-switching valve 51; a subsidiary relief passage 74 that extends from the oil passage-switching valve 51 to the suction side of the subsidiary oil pump 37; a main relief passage 73 that extends from the oil passage-switching valve 51 to the suction side of the main oil pump 36 separately from the subsidiary relief passage 74; and a check valve 75 that is provided on the downstream side of the oil passage-switching valve 51 in the subsidiary discharge passage 72 and cuts off the flow of oil from the main discharge passage 71 side to the oil passage-switching valve 51 side.

The oil passage-switching valve 51 has a main pressure-adjusting chamber 53*f* for adjusting the discharge rate of the main oil pump 36, a subsidiary pressure-adjusting chamber 53*d* for adjusting the discharge rate of the subsidiary oil pump 37, and a spool valve 53 that performs partitioning between the main pressure-adjusting chamber 53*f* and the subsidiary pressure-adjusting chamber 53*d* in an oil-tight manner.

According to this configuration, when two types of discharge pressures with a difference in height in the main oil pump 36 and the subsidiary oil pump 37 are relieved from the oil passage-switching valve 51, these respective oil discharge pressures are relieved from dedicated relief passages to the pump suction side, respectively, without joining each other within the oil passage-switching valve 51.

Additionally, by having the check valve 75 that cuts off the flow of oil from the main discharge passage 71 side to the oil passage-switching valve 51 side in the subsidiary discharge passage 72, the oil pressure of the main oil pump 36 does not flow back in the subsidiary discharge passage 72 even at the relief that the oil pressure of the subsidiary oil pump 37 in the subsidiary discharge passage 72 drops.

Thereby, it is possible to relieve the oil pressure of the main discharge passage 71 independently from the subsidiary relief passage 74, calculation of the oil pressure within the oil passage-switching valve 51 becomes easy, and the design of the oil pressure adjustment circuit can be facilitated.

Additionally, in the above embodiment, the main oil pump 36 and the subsidiary oil pump 37 are provided as separate oil pumps that line up coaxially in order to be driven by the common drive shaft 32. Thereby, driving of the main oil pump 36 and the subsidiary oil pump 37 can be made easy, and the degrees of freedom in setting the discharge rates of the main oil pump 36 and the subsidiary oil pump 37 can be enhanced.

Moreover, the oil passage-switching valve 51 has the spool valve 53, and the drive shaft 32 and the oil passage-switching valve 51 are arranged so that the axial directions thereof are parallel to each other. Thereby, the overhanging of the oil pump unit 31 including the oil passage-switching valve 51 in the radial direction of the drive shaft 32 can be suppressed.

Second Embodiment

Next, a second embodiment of the present invention will be described with reference to FIGS. 16 to 19.

This embodiment is different from the first embodiment particularly in that this embodiment includes an oil pump unit 131 not including the scavenge pump 33 and the feed pump 34 but including only the pump for control 35 (the main oil pump 36 and the subsidiary oil pump 37), and the oil passage-switching valve 51 is arranged so that the axial direction of the oil passage-switching valve is made to be orthogonal to the axial direction of the drive shaft 32 of the oil pump unit 131.

The same components as those of the first embodiment other than the above components will be designated by the same reference numerals, and the detailed description thereof will be omitted.

Figure 16:
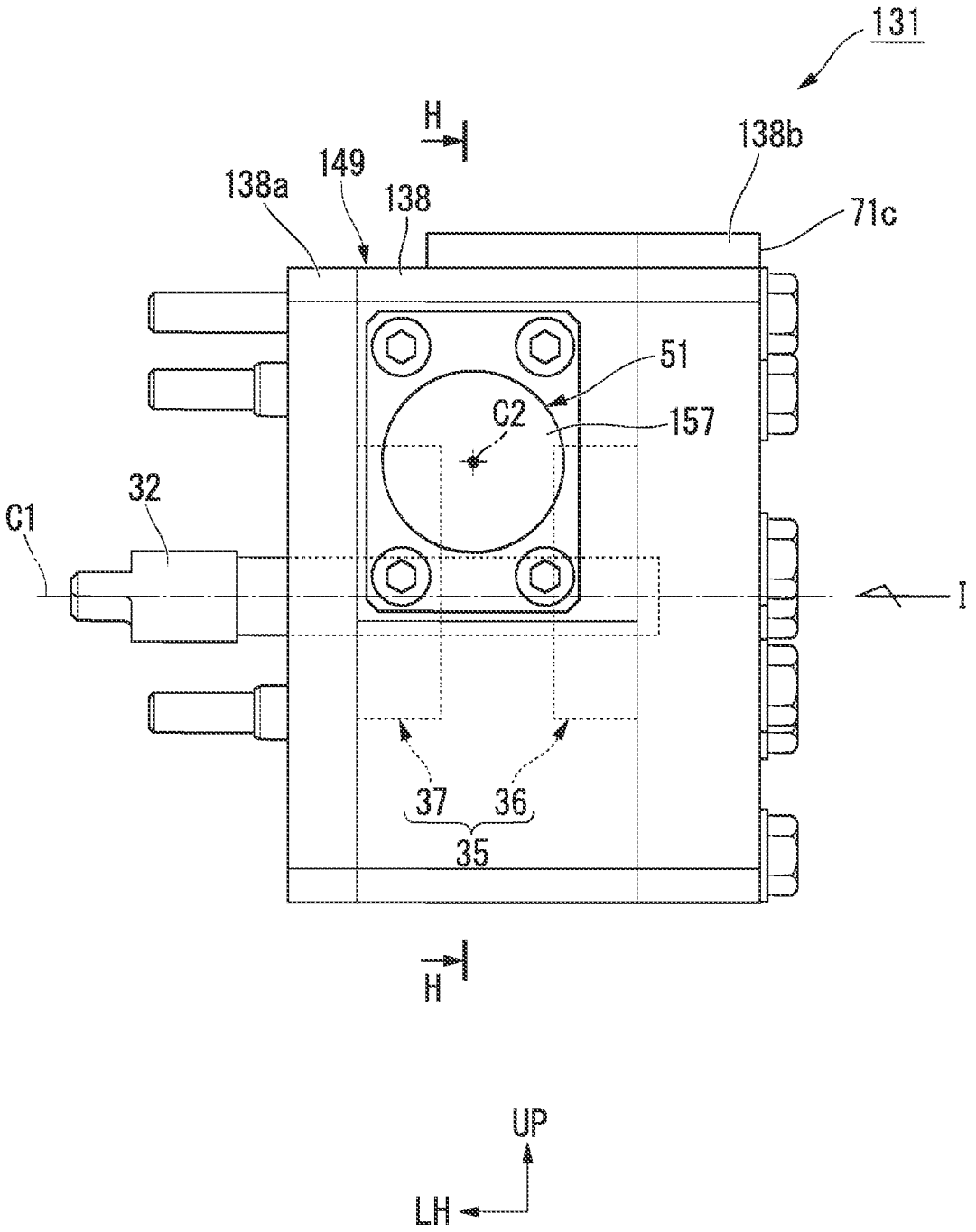
FIG. 16 is a rear view of an oil pump unit in a second embodiment of the present invention.
Figure 17:
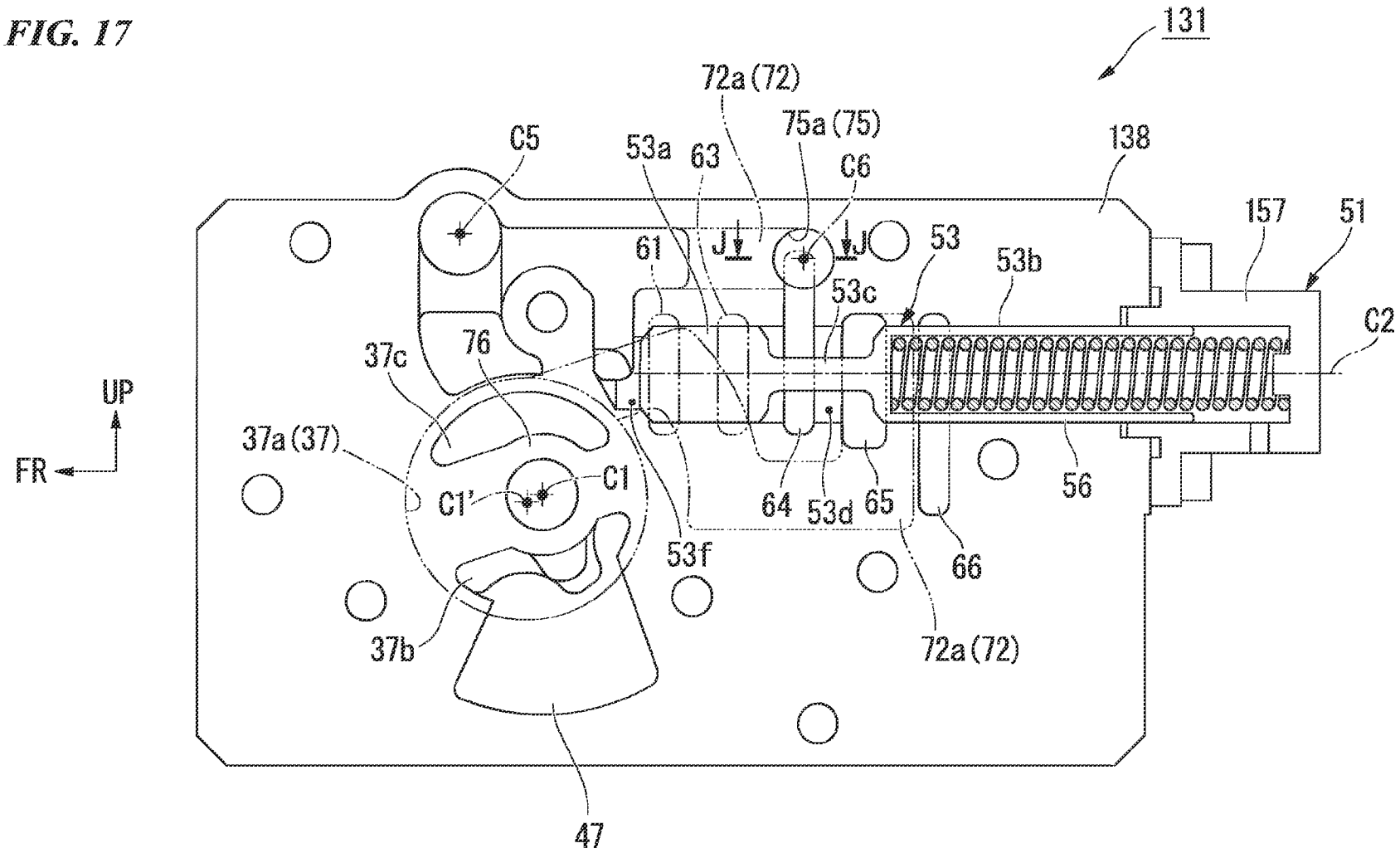
FIG. 17 is a cross-sectional view taken along line H-H of FIG. 16.

Referring to FIGS. 16 and 17, an oil pump unit 131 (variable flow rate oil pump) has a drive shaft 32 parallel to the right-and-left direction, and a driving force of a rotating part of the engine 13 is applied to this drive shaft 32 to drive the drive shaft. A pump body 138 (member) of the oil pump unit 131 forms a block shape having right and left side surfaces orthogonal to the right-and-left direction, and a left lid body 138*a* and a right body 138*b* (member) are fastened and fixed to the right-and-left side surfaces, respectively.

For example, a valve insertion hole that extends parallel to the front-and-rear direction is formed within the pump body 138 so that the axial direction thereof is made to be orthogonal to the axial direction of the drive shaft 32, and the spool valve 53 is inserted into the valve insertion hole to constitute the oil passage-switching valve 51.

The main oil pump 36 has the rotor accommodation portion 36*a* recessed in the right side surface of the pump body 138, and the subsidiary oil pump 37 has the rotor accommodation portion 37*a* recessed in the left side surface of the pump body 138. Both the respective suction ports 36*b* and 37*b* of the main oil pump 36 and the subsidiary oil pump 37 open to the communication space portion 47 therebelow. The communication space portion 47 is immersed in the oil within the oil pan 29.

The respective discharge ports 36*c* and 37*c* of the main oil pump 36 and the subsidiary oil pump 37 individually open at the upper portion of the pump body 138. The main oil pump 36 and the subsidiary oil pump 37 constitute a pump assembly 149 that forms a portion of the oil pump unit 131.

Figure 18:
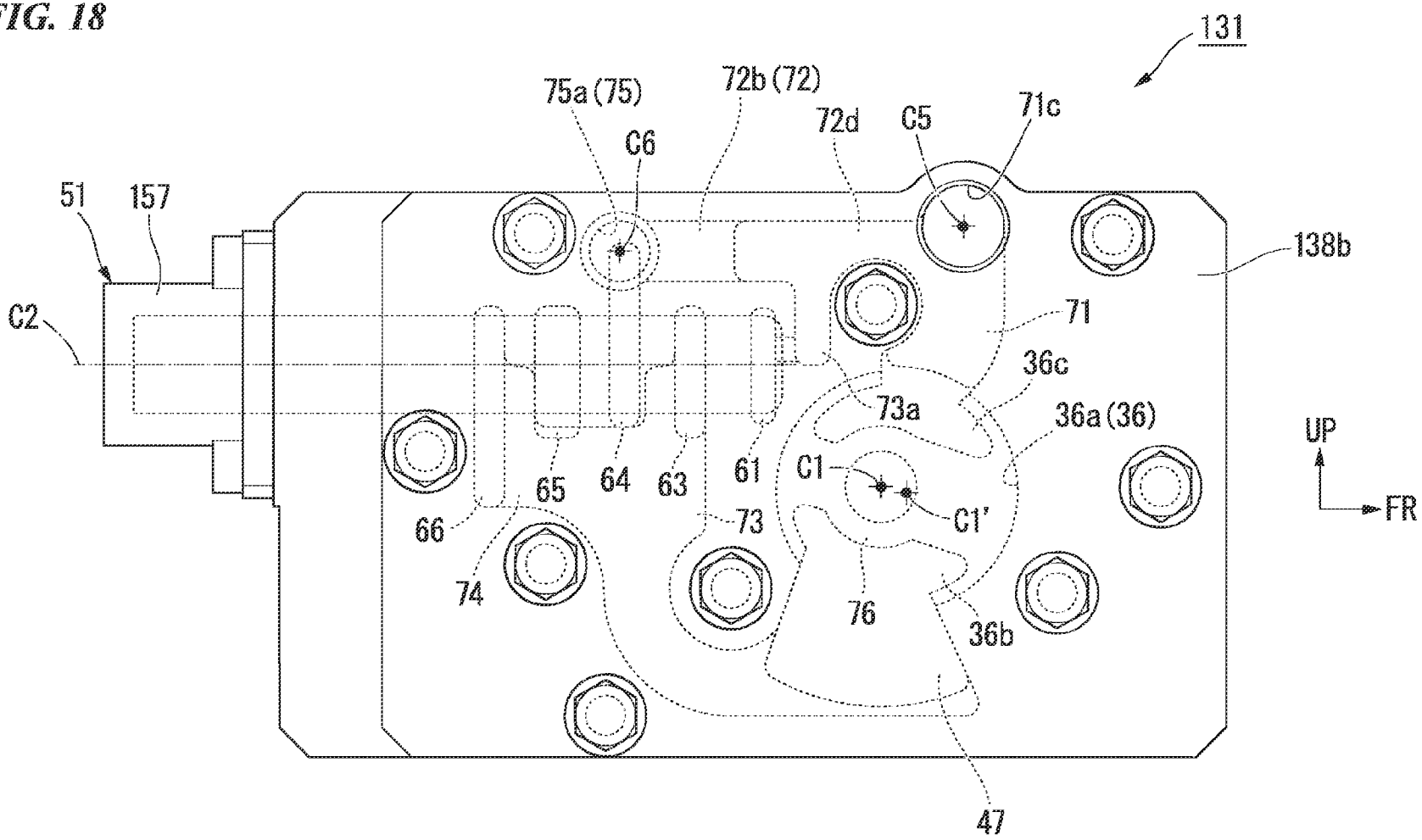
FIG. 18 is a view as seen in the direction of arrow I of FIG. 16.

Referring to FIG. 18 together, the main discharge passage 71 extends from the discharge port 36*c* of the main oil pump 36, and the subsidiary discharge passage 72 that joins the main discharge passage 71 via the oil passage-switching valve 51 extends from the discharge port 37*c* of the subsidiary oil pump 37.

The valve insertion hole of the oil passage-switching valve 51 is individually provided with the first return port 63 that communicates with the suction side of the main oil pump 36 and the second return port 66 that communicates with the suction side of the subsidiary oil pump 37. The main relief passage 73 that extends from the first return port 63 and the subsidiary relief passage 74 that extends from the second return port 66 join each other on the downstream side thereof, and lead to the communication space portion 47.

Figure 19:
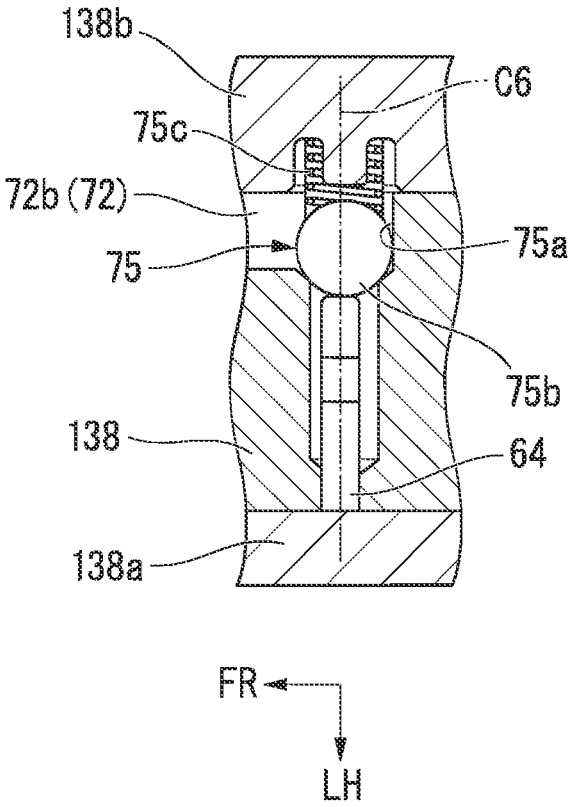
FIG. 19 is a cross-sectional view taken along line J-J of FIG. 17.

Referring to FIG. 19 together, the check valve 75 that cuts off the flow of oil from the main discharge passage 71 side to the oil passage-switching valve 51 side is provided on the downstream side (downstream subsidiary discharge passage 72*b*) of the oil passage-switching valve 51 in the subsidiary discharge passage 72.

The check valve 75 is arranged such that the axis C6 thereof runs along the right-and-left direction. The end portion of the coil spring 75*c* opposite the steel ball 75*b* is held by the right lid body 138*b*. The check valve 75 is sandwiched between the pump body 138 and the right lid body 138*b*.

The upstream main relief passage 73*a* branches from the joining portion 72*d* of the main discharge passage 71 that is joined to the subsidiary discharge passage 72, and the upstream main relief passage 73*a* is connected to the main pressure-adjusting chamber 53*f* of the oil passage-switching valve 51.

The main relief passage 73 and the upstream main relief passage 73*a* appropriately communicate with the main pressure-adjusting chamber 53*f*, and the subsidiary discharge passage 72 and the subsidiary relief passage 74 appropriately communicate with the subsidiary pressure-adjusting chamber 53*d*.

The oil passage-switching valve 51 has a valve body formed by the pump body 138 except for a rear end portion thereof. A rear end portion of the oil passage-switching valve 51 is formed by a rear cup 157 attached to the pump body 138.

The second valve portion 53*b* of the spool valve 53 serves as both a spring guide and a stopper by extending rearward. In addition, a configuration may be adopted in which the same part as the spring guide 59 of the first embodiment is provided.

The first introduction port 61, the first return port 63, the second lead-out port 64, the second introduction port 65, and the second return port 66 are respectively formed in an annular groove shape in order from right to left in the inner peripheral surface of the valve insertion hole of the oil passage-switching valve 51.

The first introduction port 61 communicates with the discharge port 36*c* of the main oil pump 36 via the upstream main relief passage 73*a*. The first return port 63 communicates with the suction port 36*b* of the main oil pump 36 via the main relief passage 73.

The second lead-out port 64 communicates with the main discharge passage 71 via the downstream subsidiary discharge passage 72*b*. The second introduction port 65 communicates with the discharge port 37*c* of the subsidiary oil pump 37 via the upstream subsidiary discharge passage 72*a*. The second return port 66 communicates with the suction port 37*b* of the subsidiary oil pump 37 via the subsidiary relief passage 74.

Even in the present embodiment, the aspects that the oil passage-switching valve 51 can have are the same as those of the first embodiment.

That is, in the present embodiment, the downstream subsidiary discharge passage 72*b* is provided with the check valve 75 that cuts off the flow of oil from the main discharge passage 71 side to the oil passage-switching valve 51 side. Thereby, even if the second lead-out port 64 and the second return port 66 communicate with each other via the subsidiary pressure-adjusting chamber 53*d*, the oil pressure of the main discharge passage 71 does not flow into the oil passage-switching valve 51.

Additionally, two types of high and low oil pressures are discharged well by separately providing the first return port 63 that communicates with the main relief passage 73 and the second return port 66 that communicates with the subsidiary relief passage 74.

As described above, even in the engine with the oil pump unit 131 in the above embodiment, the pressure interference when two types of discharge pressures with a difference in height in the main oil pump 36 and the subsidiary oil pump 37 are relieved from the oil passage-switching valve 51 is suppressed, and oil is relieved well to the pump suction side.

Additionally, by having the check valve 75 that cuts off the flow of oil from the main discharge passage 71 side to the oil passage-switching valve 51 side in the subsidiary discharge passage 72, the oil pressure of the main oil pump 36 does not flow back in the subsidiary discharge passage 72 even at the relief that the oil pressure of the subsidiary oil pump 37 in the subsidiary discharge passage 72 drops.

Thereby, it is possible to relieve the oil pressure of the main discharge passage 71 independently from the subsidiary relief passage 74, calculation of the oil pressure within the oil passage-switching valve 51 becomes easy, and the design of the oil pressure adjustment circuit can be facilitated.

Additionally, the main oil pump 36 and the subsidiary oil pump 37 have the common drive shaft 32. Thereby, the main oil pump 36 and the subsidiary oil pump 37 can be easily driven, and the degrees of freedom in setting the discharge rates of the main oil pump 36 and the subsidiary oil pump 37 can be enhanced.

Moreover, the drive shaft 32 and the oil passage-switching valve 51 are arranged so that the axial directions thereof are orthogonal to each other. Thereby, downsizing of the oil pump unit 31 including the oil passage-switching valve 51 in the radial direction of the drive shaft 32 can be achieved.

While preferred embodiments of the invention have been described and illustrated above, it should be understood that these are exemplary of the invention and are not to be considered as limiting. Additions, omissions, substitutions, and other modifications can be made without departing from the scope of the present invention. Accordingly, the invention is not to be considered as being limited by the foregoing description, and is only limited by the scope of the appended claims.

What is claimed is:

1. An engine with a variable flow rate oil pump including a main pump section and a subsidiary pump section having mutually different discharge rates, and an oil pressure-adjusting valve that adjusts supply oil pressure from the main pump section and the subsidiary pump section to oil pressure supply destinations, the engine comprising:

a main discharge passage that extends from the main pump section;

a subsidiary discharge passage that extends from the subsidiary pump section and joins the main discharge passage via the oil pressure-adjusting valve;

a subsidiary relief passage that extends from the oil pressure-adjusting valve to the suction side of the subsidiary pump section;

a main relief passage that extends from the oil pressure-adjusting valve to the suction side of the main pump section separately from the subsidiary relief passage; and a check valve that is provided on the downstream side of the oil pressure-adjusting valve in the subsidiary discharge passage and cuts off the flow of oil from the main discharge passage side to the oil pressure-adjusting valve side, wherein the oil pressure-adjusting valve has a main pressure-adjusting chamber for adjusting the discharge rate of the main pump section, a subsidiary pressure-adjusting chamber for adjusting the discharge rate of the subsidiary pump section, and a valve body that performs partitioning between the main pressure-adjusting chamber and the subsidiary pressure-adjusting chamber in an oil-tight manner.

2. The engine with a variable flow rate oil pump according to claim 1, wherein the discharge rate of the subsidiary pump section is larger than the discharge rate of the main pump section.

3. The engine with a variable flow rate oil pump according to claim 1 or 2, wherein the engine is an internal combustion engine and the main pump section and a subsidiary pump section are driven by the power of the engine.

4. The engine with a variable flow rate oil pump according to claim 1, wherein the main pump section and the subsidiary pump section are driven by a common drive shaft and are arranged so as to individually line up on the drive shaft to constitute an integral pump assembly.

5. The engine with a variable flow rate oil pump according to claim 4, wherein the check valve is provided in the subsidiary discharge passage formed in the pump assembly.

6. The engine with a variable flow rate oil pump according to claim 4 or 5, wherein the check valve is sandwiched between a plurality of members that constitute the pump assembly.

7. The engine with a variable flow rate oil pump according to claim 1, wherein the operation axis direction of the check valve is arranged parallel to the operation axis direction of the oil pressure-adjusting valve.

8. The engine with a variable flow rate oil pump according to claim 1, wherein the operation axis direction of the oil pressure-adjusting valve and the direction of the drive shaft of the variable flow rate oil pump are arranged so as to be orthogonal to each other.

* * * * *